US011669045B2

(12) United States Patent
Fujita et al.

(10) Patent No.: US 11,669,045 B2
(45) Date of Patent: Jun. 6, 2023

(54) IMAGE FORMING APPARATUS TO REDUCE EMISSION AMOUNTS

(71) Applicant: CANON KABUSHIKI KAISHA, Tokyo (JP)

(72) Inventors: Keiko Fujita, Chiba (JP); Takuya Matsumura, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/544,378

(22) Filed: Dec. 7, 2021

(65) Prior Publication Data

US 2022/0187762 A1 Jun. 16, 2022

(30) Foreign Application Priority Data

Dec. 14, 2020 (JP) ..... JP2020-207099

(51) Int. Cl.
*G03G 21/00* (2006.01)
*G03G 21/20* (2006.01)
*G03G 15/00* (2006.01)

(52) U.S. Cl.
CPC ..... *G03G 21/206* (2013.01); *G03G 15/80* (2013.01); *G03G 2221/1645* (2013.01)

(58) Field of Classification Search
CPC ..... G03G 15/80; G03G 21/206; G03G 2221/1645
USPC ..... 399/88, 92
See application file for complete search history.

(56) References Cited

U.S. PATENT DOCUMENTS 6,415,118 B1 * 7/2002 Setoriyama ..... G03G 15/00 399/92
7,558,060 B2 * 7/2009 Kiyosumi ..... B41J 2/1408 399/92
10,025,270 B2 * 7/2018 Takahashi ..... G03G 21/206
10,082,767 B2 * 9/2018 Matsumura ..... G03G 21/1619
2004/0120727 A1 * 6/2004 Komatsubara ..... G03G 21/206 399/92
2004/0228646 A1 * 11/2004 Sekiguchi ..... G03G 21/206 399/92
2016/0070231 A1 * 3/2016 Kobayashi ..... G03G 21/206 399/92
2016/0282157 A1 * 9/2016 Karakama ..... G03G 21/206

FOREIGN PATENT DOCUMENTS

JP H07271272 A 10/1995
JP 2020027119 A * 2/2020 ..... B41J 29/02

* cited by examiner

*Primary Examiner* — Robert B Beatty
(74) *Attorney, Agent, or Firm* — Canon U.S.A., Inc. I.P. Division

(57) ABSTRACT

An image forming apparatus includes a first duct unit, a first air blowing fan, a second duct unit, a filter, and a second air blowing fan. The first duct unit includes a power source substrate, a first intake portion, and a first exhaust portion. The first air blowing fan forms an airflow from the first intake portion to the first exhaust portion. The second duct unit includes a second intake portion to take air in from inside the image forming apparatus, and includes a second exhaust portion to exhaust the air taken in from the second intake portion to outside of the image forming apparatus. The filter is disposed between the second intake portion and the second exhaust portion in an airflow from the second intake portion to the second exhaust portion. The second air blowing fan forms the airflow from the second intake portion to the second exhaust portion.

15 Claims, 11 Drawing Sheets

IMAGE FORMING APPARATUS TO REDUCE EMISSION AMOUNTS

BACKGROUND

Field

The present disclosure relates to electrophotographic image forming apparatuses, such as copiers, printers, facsimiles, and multifunction peripherals having a plurality of functions of copiers, printers, facsimiles.

Description of the Related Art

In conventional image forming apparatuses, various units including an image forming unit for forming a toner image, a fixing unit for heating toner to fix toner onto a sheet, and a power source unit for supplying power to the entire apparatus may generate heat during operation of the apparatuses. In a generally used configuration of such an apparatus, air blowing fans are provided to form airflows, and air taken in from each unit is exhausted from exhaust openings to the outside of the apparatus, to discharge heat from each unit.

This configuration may cause generation of dust particles, volatile organic compounds (VOCs), ultrafine particles (UFPs), and the like in the neighborhood of the image forming unit for forming a toner image and the fixing unit for heating toner.

Japanese Patent Application Laid-Open No. 7-271272 discusses a configuration in which collecting filters are disposed in airflow paths for exhausting air taken in from an image forming unit and a fixing unit to clean the air, and the cleaned air is exhausted from exhaust openings to the outside of an apparatus.

Conventionally, cooling targets, such as the above-described power source unit, other than the image forming unit and the fixing unit may also be subjected to cooling in which air taken in from the inside of the image forming apparatus is sent to the power source unit and then exhausted.

With the recent increase in productivity, image quality, stability, life expectancy, and functionality of electrophotographic image forming apparatuses that have spread from office use to commercial printing, the apparatuses tend to increase in size and power consumption. Since the increase in the power consumption increases the amount of heat generation in a power source unit in an image forming apparatus, an air volume of an air blowing fan for discharging heat of the power source unit also tends to increase.

However, the increase in an air volume of an air blowing fan for discharging heat of a power source unit may possibly cause dust particles, VOCs, and UFPs accumulated in an image forming apparatus to flow into an airflow for the power source unit and then leak to the outside of the apparatus from an exhaust opening of the power source unit.

SUMMARY

The present disclosure is directed to providing an image forming apparatus capable of reducing an emission amount of dust particles, VOCs, and UFPs from the apparatus.

According to an aspect of the present disclosure, an image forming apparatus including an image forming unit to form a toner image on a sheet includes a fixing unit configured to heat the sheet to fix the toner image formed by the image forming unit onto the sheet, a power source substrate configured to supply power to the image forming apparatus, a cover provided with an intake opening and configuring at least a part of an exterior of the image forming apparatus, a first duct unit including the power source substrate, wherein the first duct unit includes a first intake portion configured to take air in from an outside of the image forming apparatus in the first duct unit via the intake opening of the cover, and includes a first exhaust portion configured to exhaust the air taken in from the first intake portion to an outside of the image forming unit, a first air blowing fan configured to form an airflow from the first intake portion to the first exhaust portion, a second duct unit including a second intake portion configured to take air in from a neighborhood of the fixing unit inside the image forming apparatus, and a second exhaust portion configured to exhaust the air taken in from the second intake portion to the outside of the image forming apparatus, a filter disposed between the second intake portion and the second exhaust portion in an airflow from the second intake portion to the second exhaust portion, and a second air blowing fan configured to form the airflow from the second intake portion to the second exhaust portion.

Further features of the present disclosure will become apparent from the following description of exemplary embodiments with reference to the attached drawings.

DESCRIPTION OF THE EMBODIMENTS

Exemplary embodiments of the present disclosure will be described below with reference to the accompanying drawings. However, sizes, materials, shapes, and relative arrangements of components according to the following exemplary embodiments are to be modified as required depending on the configuration of an apparatus according to the present disclosure and other various conditions. Therefore, the scope of the present disclosure is not limited to the following exemplary embodiments.

(Image Forming System)

Figure 1:
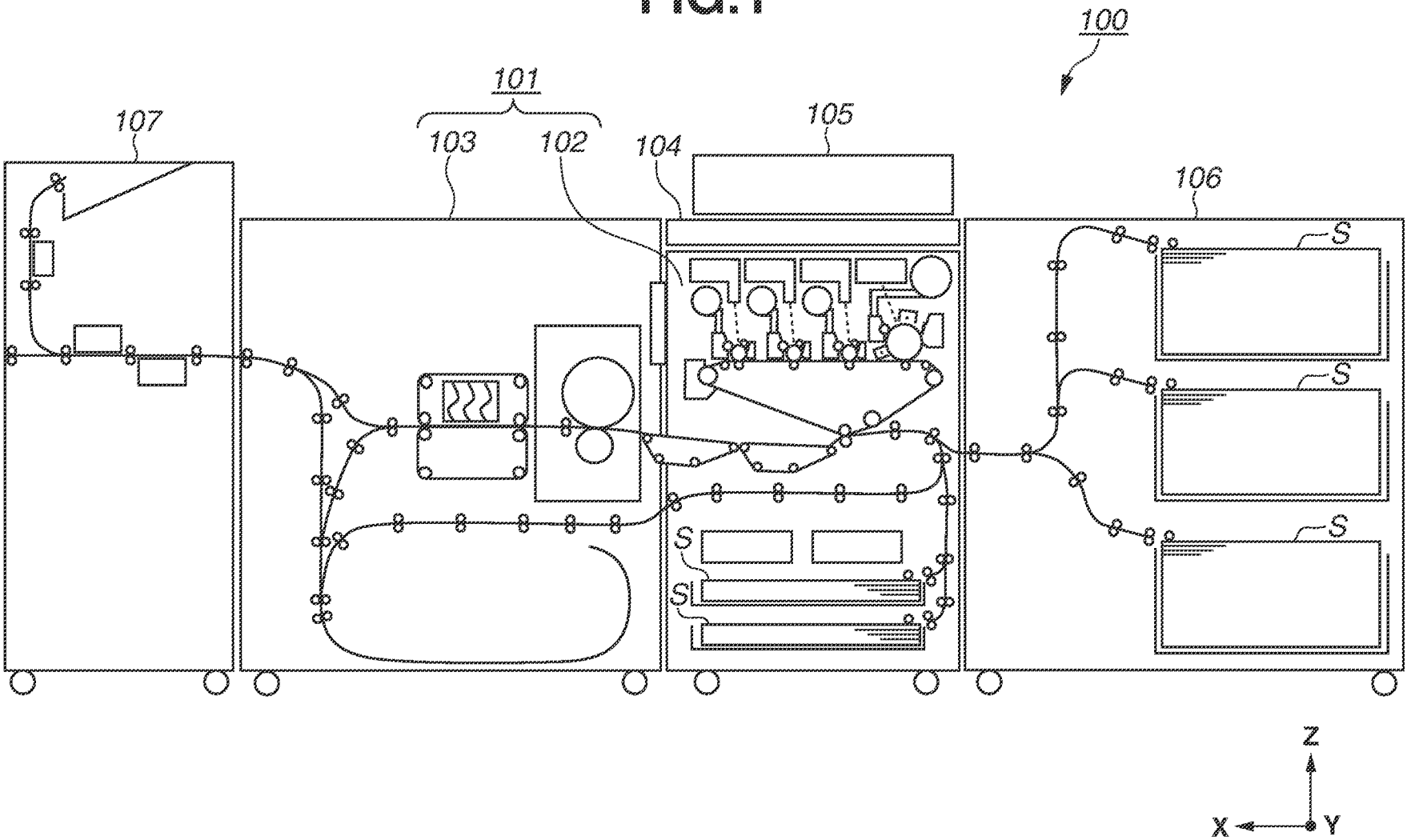
FIG. 1 is a schematic cross-sectional view illustrating an image forming system including an image forming apparatus.

FIG. 1 is a schematic cross-sectional view illustrating an image forming system 100 including an image forming apparatus 101 according to a first exemplary embodiment of the present disclosure. The image forming apparatus 101 illustrated in FIG. 1 includes an image forming unit 102 for transferring a toner image to a sheet S fed to the image forming unit 102 and a fixing conveyance unit 103 for fixing the transferred toner image onto the sheet S. The image forming unit 102 and the fixing conveyance unit 103 are each configured by an independent housing. This configuration makes it possible to perform packing and shipping of a large-sized apparatus in separate housings, and thus a workability during physical distribution up to installation can be improved.

Either of a document reading apparatus 104 for reading a document image or a document feeding apparatus 105 for supplying a plurality of documents one by one to the document reading apparatus 104 is selectively connected to the upper portion of the image forming unit 102.

Any one of a large-capacity feeding apparatus 106 having a plurality of sheet storage units, a manual feeding apparatus (not illustrated), and a long-sheet feeding apparatus (not illustrated) for storing long sheets can be selectively connected to an upstream process side of the image forming unit 102 in a sheet conveyance direction. Any one of a large-capacity feeding apparatus (not illustrated), the manual feeding apparatus, and the long-sheet feeding apparatus can be selectively connected to the further upstream process side of the large-capacity feeding apparatus 106 in a cascade way.

A sensing apparatus 107 for reading a toner image formed and fixed on one side or both sides of the sheet S to detect a density and position deviation of the image and performing feedback correction on an image signal to be transmitted to the image forming unit 102 is selectively connected to a downstream process side of the fixing conveyance unit 103 in the sheet conveyance direction.

One or a combination of two or more of an inserter, puncher, case binding machine, large-capacity stacker, folding machine, finisher, trimming machine, and other various sheet processing apparatuses (not illustrated) is selectively connected to the further downstream process side of the fixing conveyance unit 103 or the sensing apparatus 107.

As discussed above, in a state where various optional apparatuses are selectively connected to the image forming apparatus 101 according to the present exemplary embodiment on the upstream and the downstream processes sides of the image forming apparatus 101 in the sheet conveyance direction, products of diverse materials post-processed in diverse ways can be output on an inline basis. Thus, the image forming system 100 having high productivity, high image quality, high stability, and high functionality can be provided.

(Image Forming Apparatus: Image Forming Unit 102)

Figure 2A:
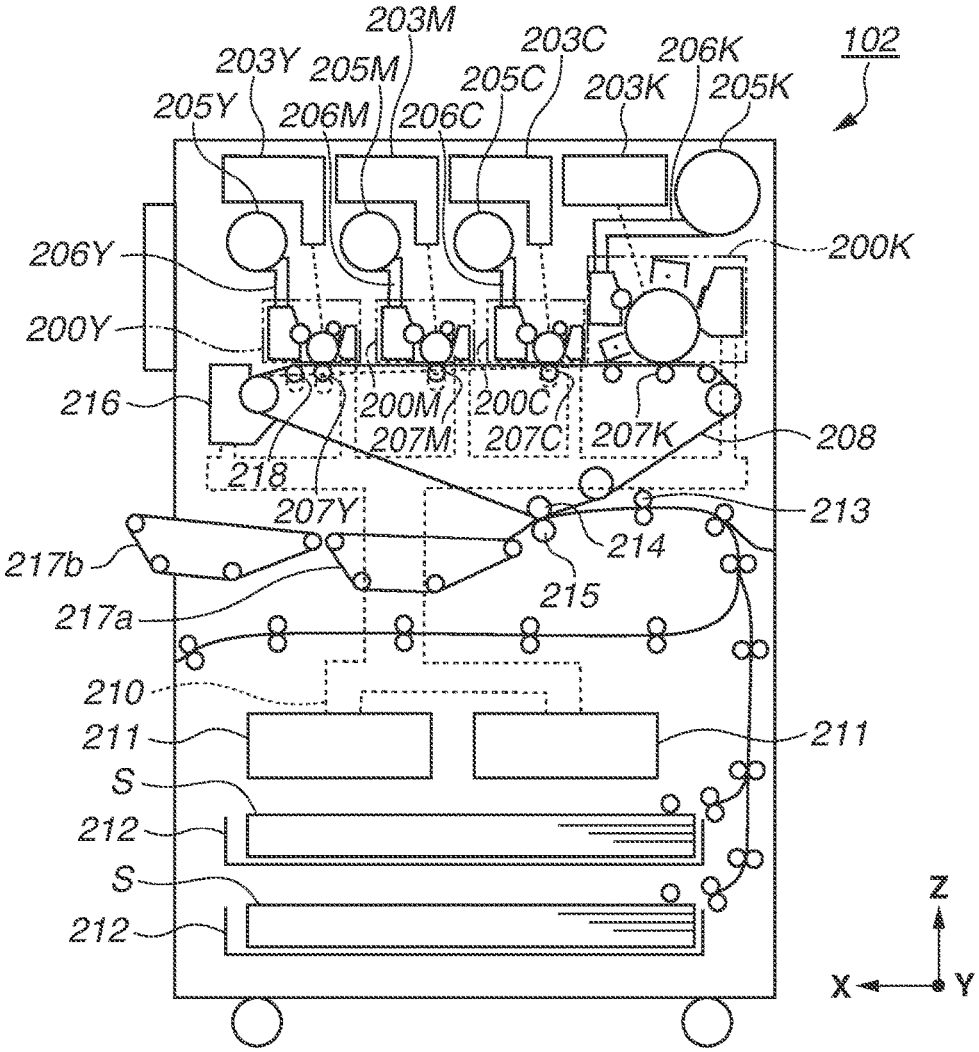
FIG. 2A is a diagram illustrating a schematic cross-sectional view of an entire image forming unit.
Figure 2B:
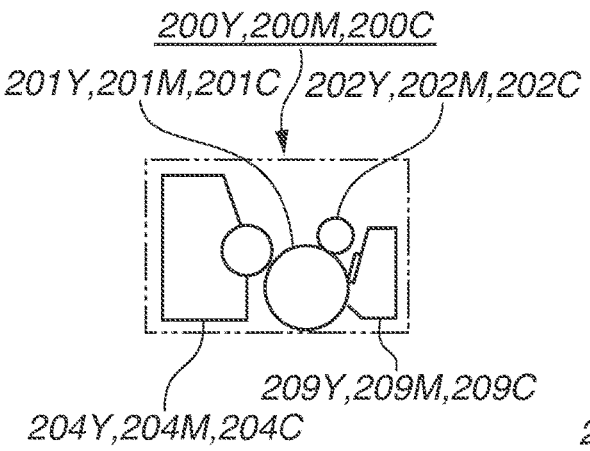
FIG. 2B is a diagram illustrating a schematic cross-sectional view of an image forming station.
Figure 2C:
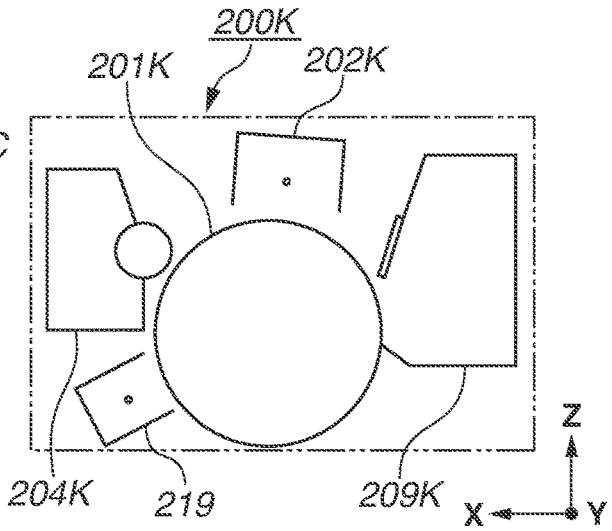
FIG. 2C is a diagram illustrating a schematic cross-sectional view of another image forming station.

FIGS. 2A, 2B and 2C are schematic cross-sectional views illustrating the image forming unit 102 in the image forming apparatus 101 according to the present exemplary embodiment. The image forming unit 102 illustrated in FIG. 2A includes a plurality of image forming stations 200 for forming toner images in different colors including yellow (Y), magenta (M), cyan (C), and black (K). These image forming stations 200 are examples of image forming units. FIG. 2A is a schematic cross-sectional view illustrating the entire image forming unit 102. FIG. 2B is a diagram illustrating a schematic cross-sectional view of an image forming station in common among image forming stations 200Y, 200M, and 200C. FIG. 2C is a schematic cross-sectional view illustrating an image forming station 200K.

As illustrated in FIG. 2A, the surface of each of photosensitive drums 201 (201Y, 201M, and 201C) in the respective image forming stations 200 (200Y, 200M, and 200C) is uniformly charged by a corresponding one of primary charging devices 202 (202Y, 202M, and 202C), and then an electrostatic latent image is formed on each of the photosensitive drums 201 by a corresponding one of laser scanners 203 (203Y, 203M, and 203C) driven by a transmitted image information signal. Each of the formed latent image is developed into a toner image by a corresponding one of development devices 204 (204Y, 204M, and 204C). Toner for the development is appropriately supplied from a corresponding one of toner bottles 205 (205Y, 205M, and 205C) to each of the development devices 204 via respective toner supply path 206 (206Y, 206M, and 206C). The image forming stations 200Y, 200M, and 200C have a common configuration but differ only in the color of the toner used. In the following descriptions of the common configuration, symbols Y, M, C, and K will be omitted. A configuration of the image forming station 200K includes different functions from the image forming stations 200Y, 200M, and 200C. The different functions will be described below.

Toner images on the photosensitive drums 201 are applied with predetermined pressure and an electrostatic load bias by primary transfer rollers 207 and then sequentially transferred onto an intermediate transfer belt 208. A small amount of residual toner remaining on the photosensitive drums 201 after the transfer is removed by photosensitive drum cleaners 209 to prepare for the next image forming. The removed residual toner is stored in collection toner containers 211 via toner collection paths 210.

Meanwhile, the sheet S fed from either one of a sheet storage unit 212 in the image forming unit 102 or the feeding apparatus connected outside the image forming apparatus 101 is subjected to skew correction in which a leading edge of the sheet S comes along the nip portion of a registration roller pair 213 to form a loop. Subsequently, the registration roller pair 213 conveys the sheet S to a secondary transfer portion in synchronization with the toner image on the intermediate transfer belt 208.

The toner image on the intermediate transfer belt 208 is transferred onto the sheet S at a secondary transfer nip portion formed by a secondary transfer inner roller 214 and a secondary transfer outer roller 215, where the toner image is applied with predetermined pressure and an electrostatic load bias. After the transfer, a small amount of residual toner remaining on the intermediate transfer belt 208 is removed by an intermediate transfer belt cleaner 216 to prepare for the next image forming. The removed residual toner is stored in the collection toner containers 211 via the toner collection paths 210. The sheet S with the toner image transferred thereon is conveyed to the fixing conveyance unit 103 on the downstream side by pre-fixing conveyance belts 217*a* and 217*b*.

(Image Forming Apparatus: Monochrome Image Forming)

In addition to the above-described full color image forming using the image forming stations 200Y, 200M, 200C, and 200K, the image forming apparatus 101 according to the present exemplary embodiment is capable of performing monochrome image forming by using the image forming station 200K.

In monochrome image forming, the primary transfer rollers 207, a primary transfer auxiliary roller 218, and the intermediate transfer belt 208 are displaced to a position drawn with the broken lines in FIG. 2A by a separation mechanism (not illustrated). This separation mechanism can stop rotational driving of the image forming stations 200Y, 200M, and 200C separated from the intermediate transfer belt 208. More specifically, in the image forming stations 200Y, 200M, and 200C, abrasions of parts accompanied with unnecessary rotational driving can be prevented, whereby the life expectancy can be prolonged.

The photosensitive drum 201K has a large diameter that is more suitable for a long operating life than the photosensitive drums 201Y, 201M, and 201C. As illustrated in FIG. 2C, a primary charging device 202K is configured by a non-contact method using a corona charging device that is more suitable for a long operating life than a contact method using a roller charging device such as the primary charging devices 202Y, 202M, and 202C. Further, a toner bottle 205K has a large capacity that is more suitable for a long operating life than the toner bottles 205Y, 205M, and 205C.

The above-described configuration is also advantageous for a user who frequently uses a monochrome image forming function since the configuration can prevent the maintenance interval of the image forming station 200K with a high use frequency from being shortened in comparison with that of the image forming stations 200Y, 200M, and 200C with a low use frequency.

The large-diameter drum configuration using the corona charging device as the primary charging device 202K provides a wider charging range and is more suitable for high-speed charging than a small-diameter drum configuration using the roller charging devices as the primary charging devices 202Y, 202M, and 202C, whereby the productivity in the monochrome image forming can be improved.

In the image forming unit 102 having the above-described operating conditions different between the image forming stations 200, differences in the shape and abrasion amount among the image forming stations 200 may cause differences in toner charge amounts on the photosensitive drums 201 among the photosensitive drums 201. If a difference in the toner charge amounts occurs, uniform toner image transfer to the sheet S may not be performed in a secondary transfer process, which can result in an image failure. Accordingly, the photosensitive drum 201K is provided with a pre-transfer charging device 219 as a corona charging device that equalizes the toner charge amount to that of the photosensitive drums 201Y, 201M, and 201C.

As discussed above, with the configuration according to the present exemplary embodiment, the image forming apparatus 101 having high productivity, high image quality, high stability, and a long life expectancy not only in full color image forming but also in monochrome image forming can be provided.

(Image Forming Apparatus: Fixing Conveyance Unit 103)

Figure 3:
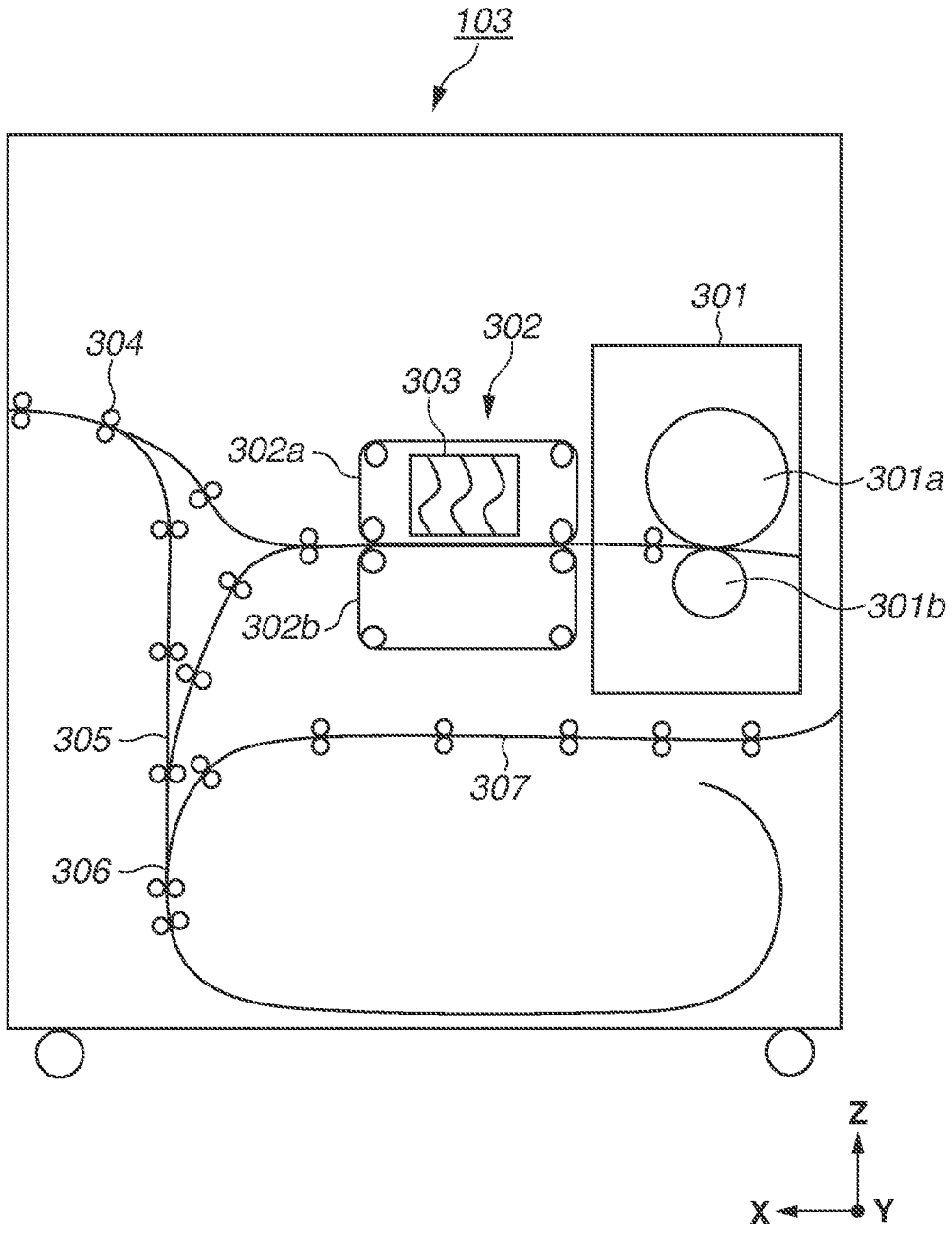
FIG. 3 is a schematic cross-sectional view illustrating a fixing conveyance unit of the image forming apparatus.

FIG. 3 is a schematic cross-sectional view illustrating the fixing conveyance unit 103 in the image forming apparatus 101 according to the present exemplary embodiment. A fixing unit 301 illustrated in FIG. 3 heats and pressurizes the toner image on the sheet S conveyed from the image forming unit 102, to fix the image onto the sheet S.

According to the present exemplary embodiment, a heating roller 301*a* to be heated by a heater (not illustrated) is disposed on a vertically upper side position in the fixing unit 301, and a pressure roller 301*b* that pressurizes the sheet S to the heating roller 301*a* is disposed on a vertically lower side position in the fixing unit 301. When the sheet S with a toner image formed thereon is heated and pressurized at a fixing nip portion formed by the heating roller 301*a* and the pressure roller 301*b*, the toner image is fixed onto the sheet S. Then, the heating roller 301*a* and the pressure roller 301*b* nip and convey the sheet S to a downstream process side in the sheet conveyance direction while heating and pressurizing the sheet S. Although, in this case, the fixing unit 301 includes a roller pair, the fixing unit 301 may include a conveyance belt to form the fixing nip portion.

The sheet S that has been heated by the fixing unit 301 is then conveyed by conveyance belts 302*a* and 302*b* of a cooling unit 302 while being cooled by heat absorption of a heat sink 303 in contact with an inner surface of the conveyance belt 302*a*. Then, the sheet S is conveyed along a sheet discharge conveyance path 304 and then discharged to the sensing apparatus 107 or a post-processing apparatus (not illustrated).

In a case of discharging the sheet S in a reversed state, the sheet S is conveyed in a switchback way at a sheet discharge reversing portion 305, and leading and trailing edges of the sheet S are reversed. The sheet S is conveyed along the sheet discharge conveyance path 304 and then discharged in a state where the front and the rear surfaces are reversed.

To form an image on both sides of the sheet S, the sheet S with an image formed on a first surface is conveyed in a switchback way by a two-sided reversing portion 306, and the leading and the trailing edges of the sheet S are reversed. The sheet S is conveyed along a sheet discharge conveyance path 307 in a state where the front and the rear surfaces are reversed. Subsequently, the sheet S is fed to the registration roller pair 213 again in synchronization with the subsequent sheet S fed from either one of the sheet storage unit 212 in the image forming unit 102 and the above-described sheet feeding apparatus externally connected. A second surface of the sheet S is subjected to a similar image forming process to the first surface, and the sheet S is conveyed along the sheet discharge conveyance path 304 and then discharged.

(Image Forming Apparatus: Airflow Arrangement)

Figure 4:
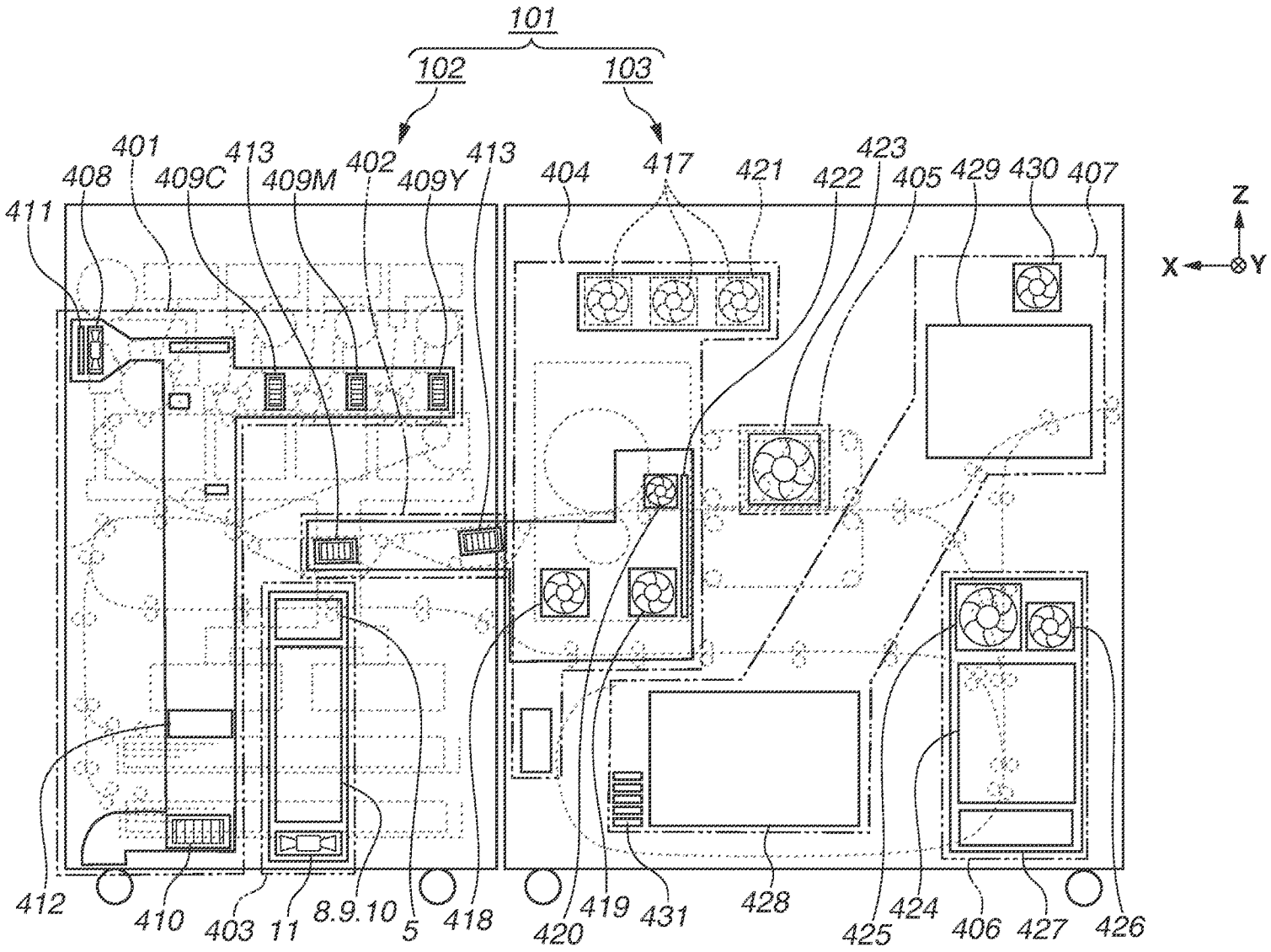
FIG. 4 is a rear view illustrating airflow arrangements in the image forming apparatus.

FIG. 4 illustrates airflow configurations in the image forming apparatus 101 according to the present exemplary embodiment when the image forming apparatus 101 is viewed from a rear face side. A front face side of the image forming apparatus 101 refers to a side where the user draws out the sheet storage unit 212 from the image forming apparatus 101 when replenishing the sheet storage unit 212 with sheets, i.e., a side on a position where the user stands to operate the image forming apparatus 101. The rear face side of the image forming apparatus 101 refers to a side opposite to the front face side in an anteroposterior direction (an insertion/removal direction of the sheet storage unit 212).

As illustrated in FIG. 4, the image forming apparatus 101 includes duct units that form an image forming airflow 401, a pre-fixing conveyance airflow 402, and a power source airflow 403. The fixing conveyance unit 103 includes duct units that form a fixing airflow 404, a cooling unit airflow 405, a power source airflow 406, and an electric device airflow 407.

The image forming airflow 401 of the image forming unit 102 includes a primary charging device intake fan 408, development device intake fans 409Y, 409M, and 409C, and an image forming exhaust fan 410.

The primary charging device intake fan 408 supplies ambient air for ventilation to the primary charging device 202K of the image forming station 200K. A primary charging device air filter 411 for collecting dust particles floating in the ambient air and supplying cleaned air to the primary charging device 202K is disposed upstream of the primary charging device intake fan 408.

The development device intake fans 409Y, 409M, and 409C supply ambient air for cooling to the development devices 204Y, 204M, and 204C.

The image forming exhaust fan 410 exhausts ozone emitted due to corona discharge occurred in the primary charging device 202K and the pre-transfer charging device 219 from the image forming station 200K. The image forming exhaust fan 410 exhausts heat emitted due to friction during rotational driving of each of the development devices 204 from each of the image forming stations 200. The image forming exhaust fan 410 exhausts internally accumulated heat from the toner collection paths 210. The image forming exhaust fan 410 further exhausts a small amount of floating toner emitted in each toner image forming process from each of the image forming stations 200. An image forming exhaust filter 412 for collecting ozone and dust particles including toner emitted from each of the image forming stations 200 and exhausting cleaned air to the outside of the image forming apparatus 101 is disposed upstream of the image forming exhaust fan 410.

In the above-described configuration of the image forming airflow 401, ozone, heat, and dust particles emitted and discharged in image forming process can be efficiently exhausted without accumulation in each of the image forming stations 200 and ozone, heat, and dust particles can be collected by using the image forming exhaust filter 412.

More specifically, the configuration can prevent charge image failures caused by, for example, uneven charging due to adhesion of ozone and dust particles to the photosensitive drums 201 and the primary charging devices 202, developed image failures caused by degraded flowability of toner due to an excessive temperature rise, and transfer image failures caused by adhesion of ozone and dust particles to the pre-transfer charging device 219.

Figure 5A:
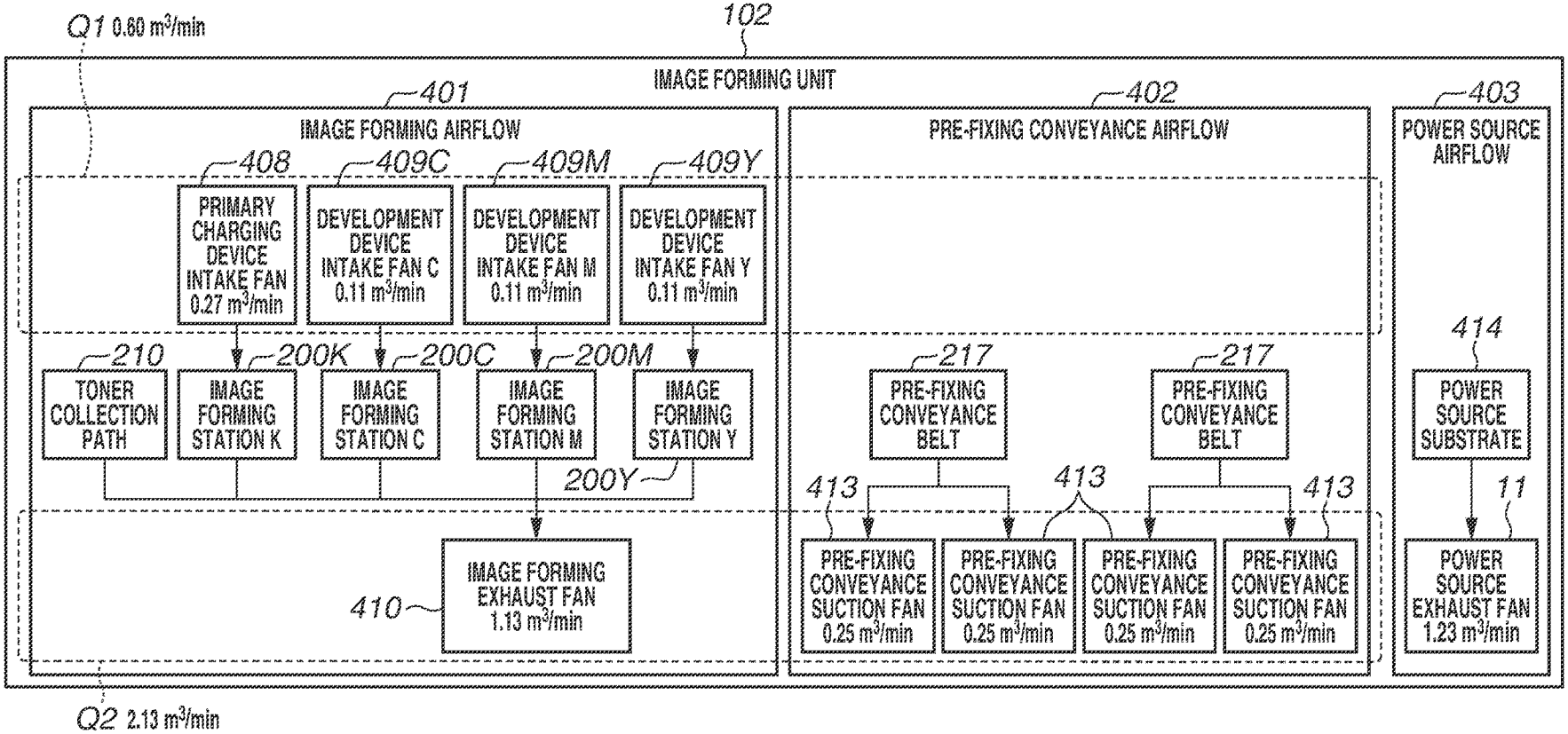
FIGS. 5A and 5B are block diagrams illustrating air volumes of fans in the image forming apparatus.

With the configuration, image forming apparatus 101 having high image quality, high stability, and a long life expectancy can be provided. Further, the image forming apparatus 101 excellent in environment-friendliness in terms of a reduced emission amount of ozone and dust particles from the image forming apparatus 101 can be provided. The image forming airflow 401 illustrated in FIG. 5A is an example of a third duct unit. The primary charging device intake fan 408, the development device intake fans 409Y, 409M, and 409C, and intake openings corresponding to respective positions of the development device intake fans 409Y, 409M, and 409C are an example of a third intake portion that takes air in from the neighborhood of the image forming unit 102. The image forming exhaust fan 410 and exhaust openings for exhausting air from the image forming apparatus 101 in the image forming airflow 401 are an example of a third exhaust portion.

An inner circumferential portions of the pre-fixing conveyance belts 217*a* and 217*b* are provided with pre-fixing conveyance suction fans 413 for suction of the sheet S to an outer circumferential surfaces of the pre-fixing conveyance belts 217*a* and 217*b* via absorption openings (not illustrated) on the pre-fixing conveyance belts 217*a* and 217*b*. Two pre-fixing conveyance suction fans 413 are provided before and after each of the pre-fixing conveyance belts 217*a* and 217*b*, i.e., a total of four pre-fixing conveyance suction fans 413 are provided. The pre-fixing conveyance airflow 402 of the image forming unit 102 is configured by the pre-fixing conveyance suction fans 413 in the above described way.

Air volumes of the pre-fixing conveyance suction fans 413 are optimally adjusted according to a material and a shape of the conveyed sheet S by a control circuit (not illustrated). In this configuration, diverse materials can be stably conveyed without causing defects in an unfixed toner image on the sheet S. Thus, the image forming apparatus 101 having high image quality, high stability, and high functionality can be provided.

The pre-fixing conveyance suction fans 413 may take in heat, volatile organic compounds (VOCs), dust particles, and ultrafine particles (UFPs) emitted from the adjacent fixing unit 301. Thus, the pre-fixing conveyance airflow 402 collects VOCs, dust particles, and UFPs with a fixing lower portion exhaust filter 422 (described below) and exhausts cleaned air from the image forming apparatus 101. With the configuration, the image forming apparatus 101 excellent in environment-friendliness in terms of a reduced emission amount of VOCs, dust particles, and UFPs from the image forming apparatus 101 can be provided.

The power source airflow 403 of the image forming unit 102 includes a power source exhaust fan 11 for exhausting heat emitted from direct current (DC) power source substrates including a first DC power source substrate 8, a DC/DC converter power source substrate 9, and a second DC power source substrate 10 from the image forming apparatus 101. With the exhaust by the power source exhaust fan 11, ambient air for cooling is supplied from a power source intake opening 5, and thus the DC power source substrates 8, 9, and 10 can be efficiently cooled. This configuration can prevent operation failures and troubles of the image forming apparatus 101 caused by reduced output of the DC power source substrates 8, 9, and 10 due to an excessive temperature rise. Accordingly, the image forming apparatus 101 having high productivity, high stability, and a long life expectancy can be provided. The configuration of a DC power source unit 1 configuring the power source airflow 403 will be described in detail below.

The fixing airflow 404 of the fixing conveyance unit 103 includes fixing heat exhaust fans 417, a fixing pressurization intake fan 418, a fixing pressurization exhaust fan 419, and a moisture exhaust fan 420.

The fixing heat exhaust fans 417 exhaust mainly heat emitted from a heating side (upper portion) of the fixing unit 301 from the image forming apparatus 101. In a case where components of the fixing unit 301 or a mold release agent (wax) contained in toner is heated, VOCs, dust particles, and UFPs may be emitted together with heat. Therefore, a fixing upper portion exhaust filter 421 that collects VOCs, dust particles, and UFPs is disposed downstream of an air current generated by the fixing heat exhaust fans 417.

The fixing pressurization intake fan 418 supplies ambient air for cooling to a pressurization side (lower portion) of the fixing unit 301. The fixing pressurization exhaust fan 419 exhausts heat emitted from the pressurization side (lower portion) of the fixing unit 301 from the image forming apparatus 101. The moisture exhaust fan 420 exhausts vapor emitted from the sheet S heated by the fixing unit 301 from the image forming apparatus 101.

The fixing lower portion exhaust filter 422 for collecting VOCs, dust particles, and UFPs emitted together with heat and vapor is disposed on a downstream side of an airflow generated by the fixing pressurization exhaust fan 419, the moisture exhaust fan 420, and the pre-fixing conveyance suction fans 413.

In the above-described configuration of the fixing airflow 404, heat, moisture, VOCs, dust particles, and UFPs emitted in the heating process can be efficiently exhausted without accumulation in the image forming apparatus 101. More specifically, the configuration can prevent image failures and operation failures caused by an excessive temperature rise of toner and parts of each unit due to the heat accumulation in the image forming apparatus 101.

The configuration can also prevent image fixing failures and sheet conveyance failures, such as fixing separation failures, caused by an excessive heat amount applied to toner in the fixing process due to an excessive temperature rise on the pressurization side of the fixing unit 301. The configuration can also prevent sheet conveyance failures and image failures caused by dew condensation on a conveyance guide due to adhesion of vapor and due to adhesion of condensed droplets to the sheet S being conveyed. The configuration can further prevent operation failures and sheet conveyance failures caused by a mold release agent (wax) once vaporized by heating and solidifies again, and adhered to the parts. Accordingly, the image forming apparatus 101 having high productivity, high stability, and a long life expectancy can be provided. Further, with the configuration, the image forming apparatus 101 excellent in environment-friendliness in terms of a reduced emission amount of VOCs, dust particles, and UFPs from the image forming apparatus 101 can be provided.

The fixing airflow 404 illustrated in FIG. 4 is an example of a second duct unit. The pre-fixing conveyance suction fans 413, the fixing pressurization intake fan 418, and intake openings corresponding to positions of these fans are an example of a second intake portion that take in air from the neighborhood of the pre-fixing unit. The fixing heat exhaust fans 417, the fixing pressurization exhaust fan 419, the moisture exhaust fan 420, and exhaust openings for exhausting air out of the image forming apparatus 101 in the fixing airflow 404 are an example of a second exhaust portion.

The cooling unit airflow 405 of the fixing conveyance unit 103 includes a cooling unit exhaust fan 423 that exhausts heat emitted from the heat sink 303 disposed inside the cooling unit 302 from the image forming apparatus 101. The heat sink 303 of the cooling unit 302 is a heat exchanger that absorbs heat from the sheet S after the fixing, via the conveyance belt 302*a* and discharges the absorbed heat. In this configuration, the sheet S heated by the fixing unit 301 can be efficiently cooled, and consequently, an amount of heat radiation from the sheet S in the conveyance path on the downstream process side can be reduced.

More specifically, the configuration can prevent image failures and operation failures caused by an excessive temperature rise of toner in the image forming unit 102 due to heat radiation from the sheet S during double-sided image forming. The configuration can also prevent sticking of a toner image between sheets S in a case where a large amount of products are stacked on the post-processing apparatus. Accordingly, the image forming apparatus 101 having high image quality and high stability can be provided.

The power source airflow 406 of the fixing conveyance unit 103 includes power source exhaust fans 425 and 426 that exhaust heat emitted from a power source substrate 424. With the exhaust by the power source exhaust fans 425 and 426, a power source intake opening 427 supplies air for cooling, whereby the power source substrate 424 can be efficiently cooled. This configuration can prevent operation failures and troubles caused by reduced output of the power source substrate 424 due to an excessive temperature rise. Accordingly, the image forming apparatus 101 having high productivity and high stability can be provided.

The electric device airflow 407 of the fixing conveyance unit 103 includes an electric device exhaust fan 430 that exhausts heat emitted from electric device substrates 428 and 429. With the exhaust by the electric device exhaust fan 430, an electric device intake opening 431 supplies air for cooling, whereby the electric device substrates 428 and 429 can be efficiently cooled. This configuration can prevent operation failures and troubles caused by reduced output of the electric device substrates 428 and 429 due to an excessive temperature rise. Accordingly, the image forming apparatus 101 having high productivity and high stability can be provided.

(Image Forming Apparatus: Airflow Balance)

Figure 5B:
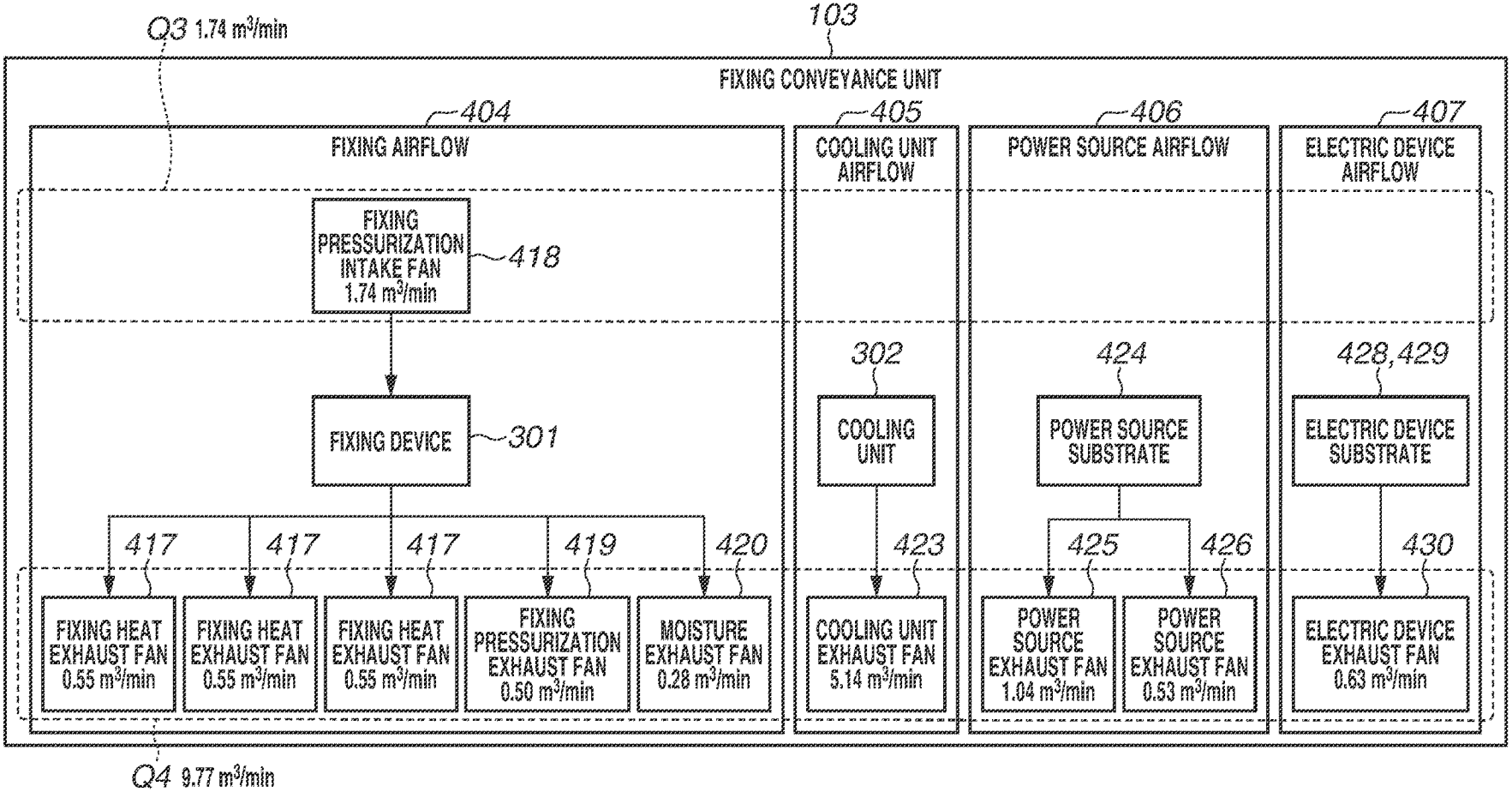

FIGS. 5A and 5B are block diagrams illustrating air volumes of the intake and exhaust fans in the image forming apparatus 101 according to the present exemplary embodiment. FIG. 5A illustrates air volumes of the fans in the image forming unit 102, and FIG. 5B illustrate air volumes of the fans in the fixing conveyance unit 103. The numerical values illustrated in FIGS. 5A and 5B indicate examples of air volumes of the fans when thick paper is subjected to image forming.

Broken lines in FIG. 5A indicate a total range of a total air volume Q1 of intake fans and a total air volume Q2 of exhaust fans acting on the inside of the image forming unit 102 of the image forming apparatus 101. The power source airflow 403 is formed of an independent air path not communicating with the inside of the image forming unit 102 and the fixing conveyance unit 103, and is configured to directly take in ambient air and exhaust air from and to the outside. Thus, since the power source airflow 403 does not have an effect on airflows in the image forming unit 102, the power source airflow 403 is excluded from the total value. The intake fans refer to fans that take ambient air around the image forming apparatus 101 in the image forming apparatus 101. Among the fans disposed in the image forming unit 102, the primary charging device intake fan 408 and the development device intake fans 409C, 409M, and 409Y are the intake fans. The exhaust fans refer to fans that exhaust air in the image forming apparatus 101 from the image forming apparatus 101. Among the fans disposed in the image forming unit 102, the image forming exhaust fan 410 and the four pre-fixing conveyance suction fans 413 are the exhaust fans.

In the present exemplary embodiment, the total air volume Q2 of the exhaust fans in the image forming unit 102 in the image forming apparatus 101 is configured to be larger than the total air volume Q1 of the intake fans as follows:

$$Q1=0.60\ \mathrm{m^3/min}<Q2=2.13\ \mathrm{m^3/min}$$

In this configuration, the inside of the image forming unit 102 can be maintained to be under a relatively negative pressure with respect to ambient air. This configuration can prevent leakage of ozone and dust particles in the image forming unit 102 from the image forming apparatus 101 through minute clearances, such as joints of exterior covers. More specifically, the image forming exhaust filter 412 disposed at an airflow exhaust opening of the image forming unit 102 reliably collects ozone and dust particles in the image forming apparatus 101, whereby the image forming apparatus 101 excellent in environment-friendliness can be provided.

Broken lines in FIG. 5B indicate a total range of a total air volume Q3 of an intake fan and a total air volume Q4 of exhaust fans acting on the inside of the fixing conveyance unit 103 of the image forming apparatus 101. The intake fans refer to fans that take ambient air around the image forming apparatus 101 in the image forming apparatus 101. Among the fans disposed in the fixing conveyance unit 103, the fixing pressurization intake fan 418 is the intake fan.

The exhaust fans refer to fans that exhaust air in the image forming apparatus 101 from the image forming apparatus 101. Among the fans disposed in the fixing conveyance unit 103, the three fixing heat exhaust fans 417, the fixing pressurization exhaust fan 419, the moisture exhaust fan 420, the cooling unit exhaust fan 423, the power source exhaust fans 425 and 426, and the electric device exhaust fan 430 are the exhaust fans.

In the present exemplary embodiment, the total air volume Q4 of the exhaust fans is configured to be larger than the total air volume Q3 of the intake fan as follows:

$$Q3=1.74\ m^3/min<Q4=9.77\ m^3/min$$

In this configuration, the inside of the fixing conveyance unit 103 can be maintained to be under a relatively negative pressure with respect to ambient air. This configuration therefore can prevent leakage of VOCs, dust particles, and UFPs in the fixing conveyance unit 103 from the image forming apparatus 101 through minute clearances, such as joints of the exterior covers. More specifically, the fixing upper portion exhaust filter 421 and the fixing lower portion exhaust filter 422 disposed at the airflow exhaust opening of the fixing conveyance unit 103 reliably collect VOCs, dust particles, and UFPs in the image forming apparatus 101, whereby the image forming apparatus 101 excellent in environment-friendliness can be provided.

Further, in the present exemplary embodiment, an air volume difference between the total air volumes Q4 and Q3 of the exhaust fans in the fixing conveyance unit 103 is configured to be larger than an air volume difference between the total air volumes Q2 and Q1 of the exhaust fans in the image forming unit 102 as follows:

$$(Q2-Q1)=1.53\ m^3/min<(Q4-Q3)=8.03\ m^3/min$$

In this configuration, the inside of the fixing conveyance unit 103 can be maintained to be under a relatively negative pressure with respect to the inside of the image forming unit 102. This configuration therefore can prevent heat, VOCs, dust particles, UFPs, and vapor emitted inside the fixing conveyance unit 103 from flowing into the image forming unit 102 through a communication portion between the image forming unit 102 and the fixing conveyance unit 103. More specifically, this configuration can prevent heat, VOCs, dust particles, UFPs, and vapor which are likely to occur in the neighborhood of the fixing unit 301 from flowing into a housing of the image forming unit 102 disposed adjacent to the fixing conveyance unit 103.

Consequently, this configuration can prevent image failures and operation failures caused by degraded flowability of toner due to a heat inflow from the fixing unit 301 into the image forming unit 102, prevent image failures, sheet conveyance failures, and operation failures caused by an inflow and adhesion of VOCs, dust particles, and UFPs to parts in the image forming unit 102, and prevent image failures and sheet conveyance failures caused by dew condensation on the parts due to a vapor inflow.

Accordingly, with the above-described configuration, heat emitted in the fixing conveyance unit 103 is efficiently exhausted from the airflow exhaust openings of the fixing conveyance unit 103 without accumulating in the image forming unit 102, and VOCs, dust particles, and UFPs are reliably collected by the fixing upper portion exhaust filter 421 and the fixing lower portion exhaust filter 422 disposed at the exhaust openings, whereby the image forming apparatus 101 excellent in environmental-friendliness having high image quality, high stability, and a long life expectancy can be provided.

(Image Forming Unit: Power Source Airflow)

As illustrated in FIGS. 5A and 5B, the power source exhaust fan 11 in the image forming unit 102 according to the present exemplary embodiment provides the largest air volume among the fans in the image forming unit 102, and provides the second largest air volume next to the cooling unit exhaust fan 423 in the entire image forming apparatus 101 including the fixing conveyance unit 103. With an increase in a power consumption by the image forming apparatus 101, amounts of heat generation by the DC power source substrates 8, 9, and 10 also increase, and thus the air volume of the power source exhaust fan 11 is increased. This tendency becomes more remarkable in the image forming apparatus 101 in a large size having a large power consumption for use in commercial printing.

If the power source airflow 403 including the power source exhaust fan 11 having a large air volume affects other airflows, ozone, dust particles, VOCs, or UFPs, which should be collected by the image forming exhaust filter 412, the fixing upper portion exhaust filter 421, and the fixing lower portion exhaust filter 422, may be discharged through the exhaust opening of the power source exhaust fan 11 from the image forming apparatus 101. Thus, in the present exemplary embodiment, the power source airflow 403 is formed of an independent air path not communicating with the inside of the image forming unit 102 and the fixing conveyance unit 103 so that the power source airflow 403 does not affect other airflows.

The configuration of the DC power source unit 1 configuring the power source airflow 403 of the image forming unit 102 will be described in detail below with reference to FIGS. 6 to 10A and 10B.

Figure 6:
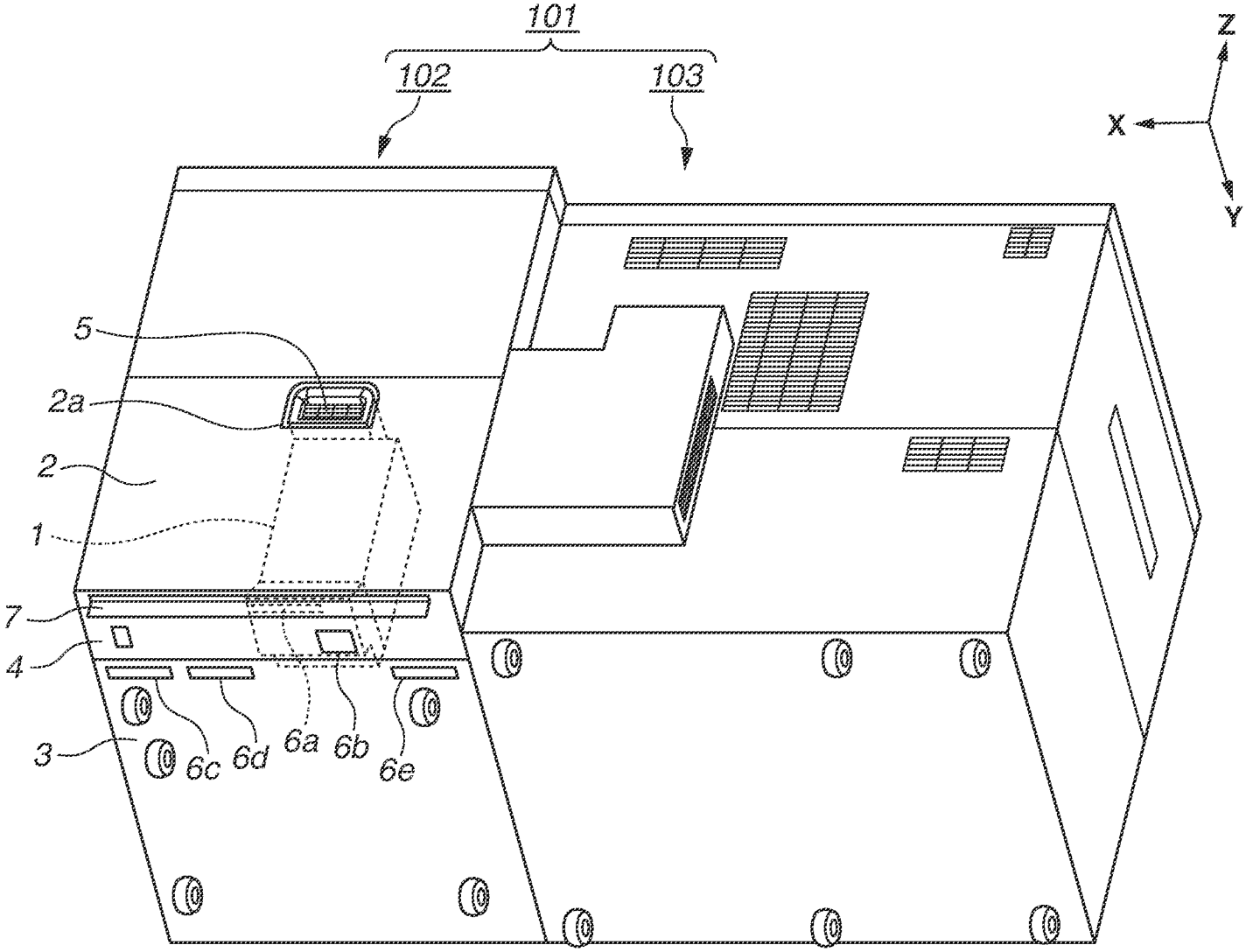
FIG. 6 is a perspective view illustrating an outer appearance of the image forming apparatus.

FIG. 6 is a perspective view illustrating an outer appearance of the image forming apparatus 101 according to the present exemplary embodiment when viewed from the lower side on the rear face side.

As illustrated in FIG. 6, the DC power source unit 1 drawn with broken lines is disposed adjacent to a rear cover 2 covering the rear surface of the image forming unit 102 and adjacent to bottom plates 3 and 4 facing an installation surface, such as the floor. The rear cover 2 is an exterior cover configuring at least a part of an exterior on the rear face side of the image forming apparatus 101. The rear cover 2 has an opening 2*a* for exposing the power source intake opening 5 of the DC power source unit 1. The bottom plates 3 and 4 has a plurality of exhaust openings 6*a* to 6*e* which are for exhausting air discharged from the DC power source unit 1 from the image forming apparatus 101. An under surface of the bottom plate 4 is provided with a shielding sheet 7 that is disposed across the bottom plate 4 and the floor surface. The shielding sheet 7 prevents heat discharged from the plurality of exhaust openings 6*a* to 6*e* from flowing into the power source intake opening 5. In the present exemplary embodiment, while the opening 2*a* is formed at the position illustrated in FIG. 6, the opening 2*a* may be disposed at a different position as long as the opening 2*a* is on the rear face side of the image forming apparatus 101. For example, the opening 2*a* may be disposed at a position closer to the rear face side than the rear cover of the fixing conveyance unit 103 in the anteroposterior direction of the image forming apparatus 101, i.e., a position on the rear face side on the right-hand surface of the image forming unit 102. In this configuration, the DC power source unit 1 (described below) may be disposed at a position corresponding to the position of the opening 2*a*.

As illustrated in FIG. 6, in the image forming apparatus 101 according to the present exemplary embodiment, the image forming unit 102 and the fixing conveyance unit 103 are each provided with a plurality of casters that makes the units movable.

The image forming unit 102 includes a support frame member (not illustrated) for supporting the image forming stations 200 and other units. The fixing conveyance unit 103 includes a support frame member (not illustrated) for supporting the fixing unit 301, the cooling unit 302, and other units.

The support frame member of the image forming unit 102 includes a plurality of brace members fixed to the bottom plate 3 and extending vertically upward, a front panel fixed to the brace members on the front face side of the image forming apparatus 101, a rear panel fixed to the bottom plate 3 on the rear face side of the image forming apparatus 101, a plurality of stays for connecting the brace members and the rear panel, and the like. The image forming stations 200 and other units are mainly supported by the front and the rear plates.

The plurality of brace members and rear plates are fixed to the bottom plate 3 by welding and screws but not fixed to the bottom plate 4. Thus, the bottom plate 3 supporting the brace members and the rear plate for supporting such heavy units including the image forming stations 200 is formed of a double structure of sheet metals to provide higher rigidity than the bottom plate 4. Consequently, all of the casters of the image forming unit 102 are attached to the bottom plate 3.

The DC power source unit 1 illustrated in FIG. 6 is disposed between the rear plate as the above-described support frame member and the rear cover 2 in the direction of an arrow Y (in the anteroposterior direction of the image forming apparatus 101) and is fixed to the bottom plate 4.

Figure 7B:
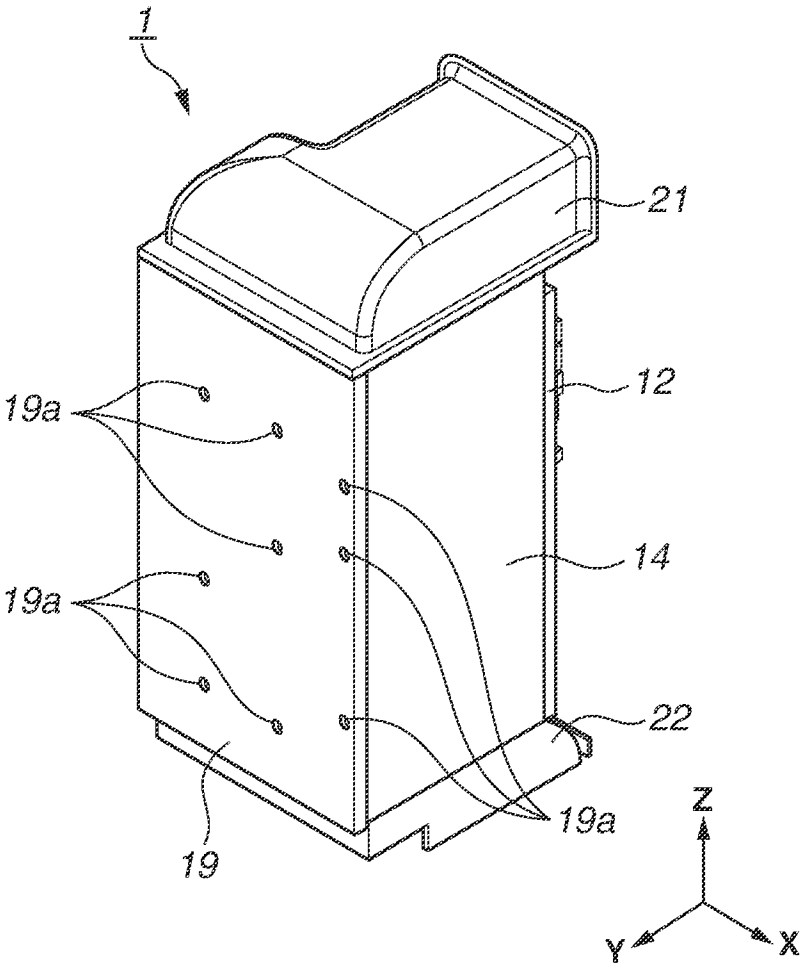
FIGS. 7A and 7B are perspective views illustrating outer appearances of a direct current (DC) power source unit.
Figure 7A:
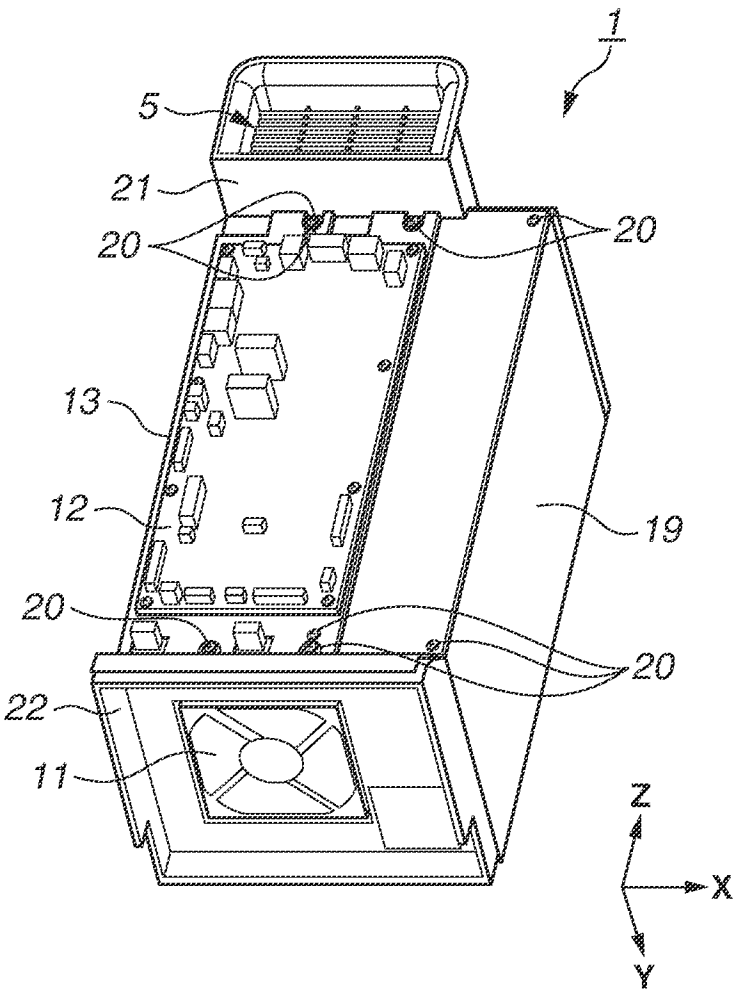

FIGS. 7A and 7B are perspective views illustrating the DC power source unit 1 according to the present exemplary embodiment. FIG. 7A is a perspective view illustrating the DC power source unit 1 viewed from the inside of the image forming apparatus 101 and the vertically lower side. FIG. 7B is a perspective view illustrating the DC power source unit 1 viewed from the outside of the image forming apparatus 101 and the vertically upper side. The DC power source unit 1 generates DC power from a commercial alternate current (AC) power supply. The DC power source unit 1 incorporates a plurality of DC power source substrates 8, 9, and 10 that supply power to control substrates and electrical components. Side faces of a housing of the DC power source unit 1 are made of sheet metals. The DC power source unit 1 is covered by a metallic material to shield radiation noise from the internally stored DC power source substrates 8, 9, and 10. If an excessive temperature rise exceeding a permissible temperature occurs in any electronic elements mounted on the DC power source substrates 8, 9, and 10, output decreases occur, which possibly causes operation failures and troubles. Thus, the power source exhaust fan 11 for exhausting heat emitted from the DC power source substrates 8, 9, and 10 is disposed to maintain the inside of the DC power source unit 1 at an appropriate temperature or lower.

As described above, the power source exhaust fan 11 according to the present exemplary embodiment is disposed at a position where the power source exhaust fan 11 exhausts air in the DC power source unit 1 in a vertically downward direction at the rear bottom portion of the image forming apparatus 101. Thus, even in a case where the power source exhaust fan 11 has a large air volume and emits a large operation sound, the fan is disposed at a position apart from the user standing in front of the image forming apparatus 101, which makes it possible to reduce the operation sound. In the configuration in which air is downwardly exhausted, troubles of electronic elements due to an intake of dust particles accumulating on the floor surface into the DC power source unit 1 can be also reduced in comparison with a case of a configuration in which intake of air is from the lower side and exhausting air is from the upper side with a similar arrangement, whereby operation of the image forming apparatus 101 can be stabilized.

Referring to FIG. 7B, a relay substrate 12 disposed outside the housing of the DC power source unit 1 has a function of distributing power output from the DC power source substrates 8, 9, and 10 stored in the housing to control substrates and electrical components (not illustrated). Since the relay substrate 12 emits a small amount of noise and heat radiation, the relay substrate 12 is supported by a relay substrate support plate 13 outside the housing of the DC power source unit 1. The relay substrate support plate 13 is a component of the housing of the DC power source unit 1 and defines a space in the image forming apparatus 101 and a space the DC power source unit 1.

Figure 8B:
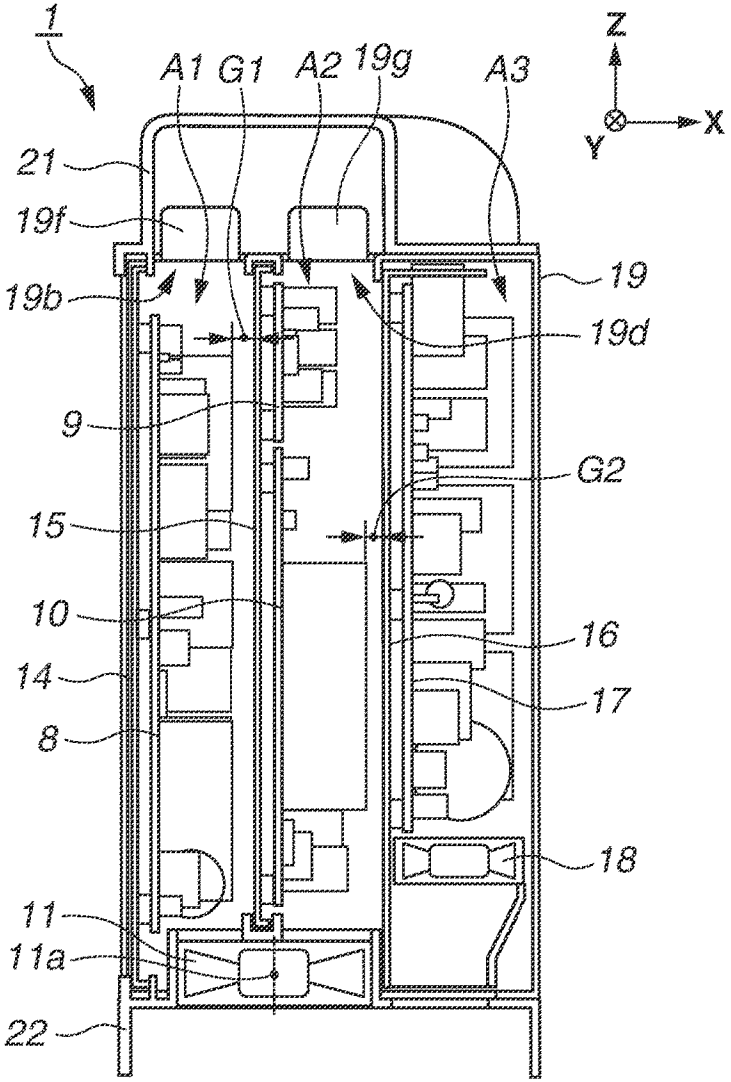
FIGS. 8A and 8B are cross-sectional views illustrating the DC power source unit.
Figure 8A:
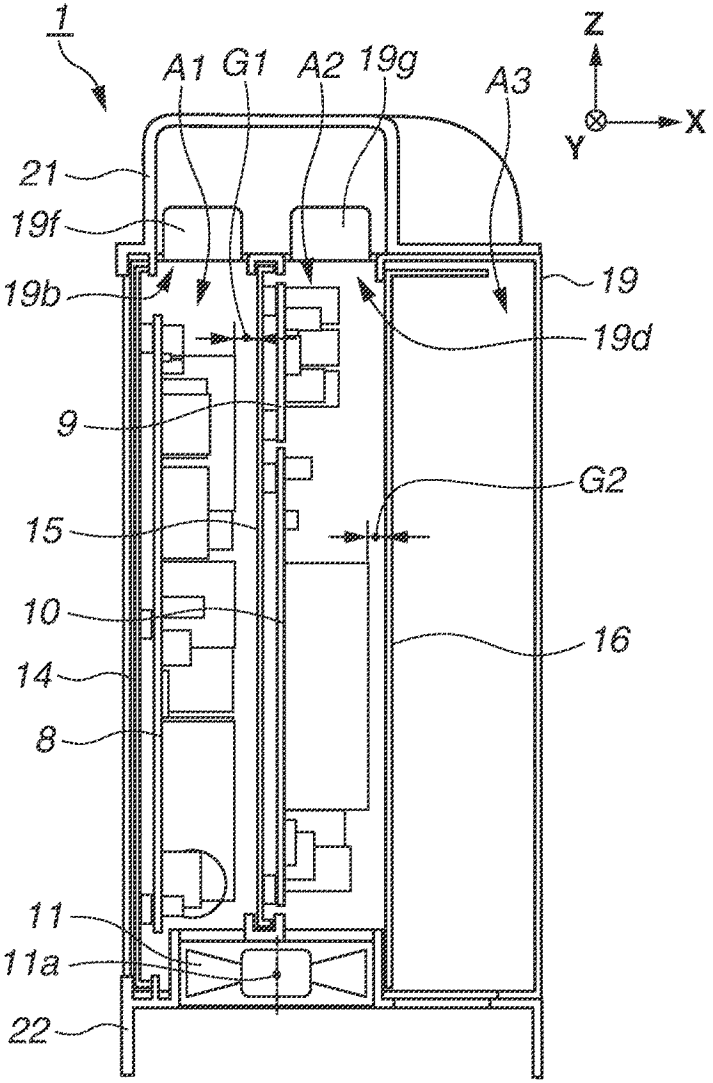

FIGS. 8A and 8B are cross-sectional views illustrating the DC power source unit 1 according to the present exemplary embodiment when viewed from the rear side.

As illustrated in FIGS. 8A and 8B, the inside of the DC power source unit 1 according to the present exemplary embodiment is divided into three different areas including a first area A1, a second area A2, and a third area A3.

In the first area A1, the first DC power source substrate 8 that supplies 12 and 24 VDC power is supported by a first power source substrate support plate 14 made of a sheet metal. The first power source substrate support plate 14 has a function of defining the inside and the outside of the DC power source unit 1 as an aspect of the housing.

In the second area A2, the DC/DC converter power source substrate 9 for converting 24 VDC power into 38 VDC power and supplying the DC power is disposed at the upper portion, and the second DC power source substrate 10 for supplying 24 VDC power is disposed at the lower portion. These two substrates are supported by a second power source substrate support plate 15 made of a sheet metal. The second power source substrate support plate 15 functions as a partition plate for defining the first area A1 and the second area A2 of the DC power source unit 1.

The DC power source unit 1 according to the present exemplary embodiment is configured for general purpose use, i.e., commonly used in a plurality of different products. FIG. 8A illustrates an example case where the DC power source unit 1 is used for the image forming apparatus 101 according to the present exemplary embodiment. In the third area A3 of the DC power source unit 1, no DC power source substrate is disposed, and a third power source substrate support plate 16 is disposed. FIG. 8B illustrates an example case where the DC power source unit 1 is used for a different image forming apparatus (not illustrated). In the third area A3 of the DC power source unit 1, an Induction Heating (IH) power source substrate 17 and an IH power source exhaust fan 18 for exhausting heat of the IH power source substrate 17 are supported by the third power source substrate support plate 16 made of a sheet metal. The third power source substrate support plate 16 functions as a partition plate for defining the second area A2 and the third area A3 of the DC power source unit 1.

The power source exhaust fan 11 is disposed across the first area A1 and the second area A2. Exhausting heat with a fan is not necessary for the DC/DC converter power source substrate 9 according to the present exemplary embodiment since the DC/DC converter power source substrate 9 mounts no electronic element in which an excessive temperature rise occurs. Thus, the power source exhaust fan 11 is disposed mainly for the purpose of exhausting heat from the first DC power source substrate 8 and the second DC power source substrate 10.

As illustrated in FIGS. 8A and 8B, the first DC power source substrate 8 and the second DC power source substrate 10 mounts many parts largely protruding from the mounting surface. Consequently, the parts mounted on these substrates may serve as a barrier that is likely to disturb a vertically downward airflow by the power source exhaust fan 11.

With the power source exhaust fan 11 which is disposed to supply air flows in a first gap G1 between an uppermost faces of the mounted parts and the second power source substrate support plate 15 as a partition plate, and a second gap G2 between an uppermost faces of the mounted parts and the third power source substrate support plate 16 as a partition plate, the air volume further increases and efficiency of heat discharge can be improved. More specifically, according to the present exemplary embodiment, efficiency of heat discharge by increasing an air volume is improved by a configuration in which the power source exhaust fan 11 is disposed across the first gap G1 and the second gap G2 and a rotation center 11*a* is sets on a position closer to the side of the second area A2 than the side of the first area A1.

Figure 9:
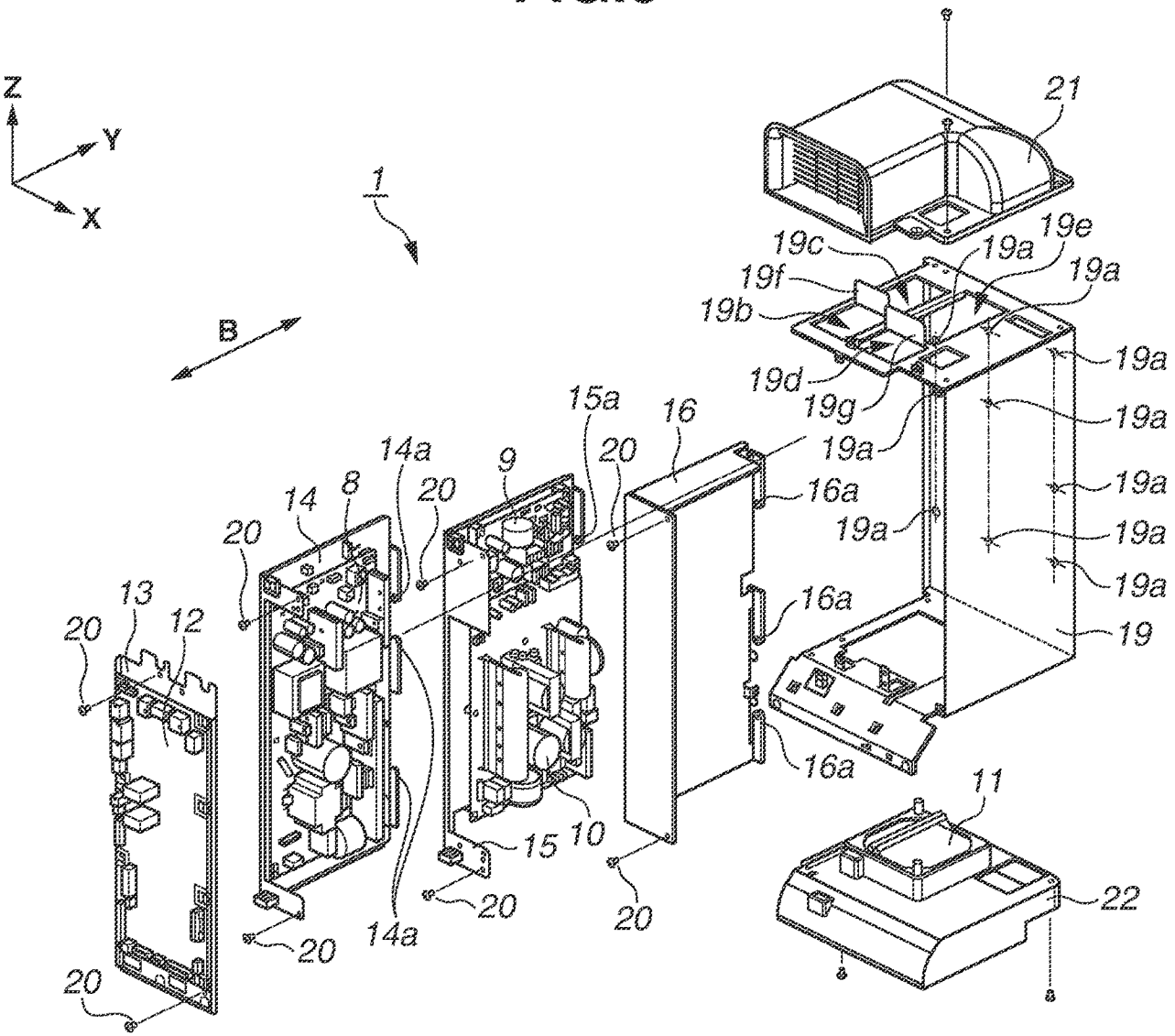
FIG. 9 is an exploded view illustrating the DC power source unit.

FIG. 9 is an exploded perspective view illustrating the DC power source unit 1 according to the present exemplary embodiment. As illustrated in FIG. 9, each of the substrate support plates 13, 14, 15, and 16 is configured to be inserted into and removed from a power source box 19 in a direction of an arrow B in FIG. 9 by removing fastening screws 20 at two positions. Accordingly, a maintenance operation, such as replacement of the substrates 8, 9, 10, 12, and 17 can be performed by a simple operation, by removing the fastening screws 20 at the two positions and then removing and inserting each of the substrate support plates 13, 14, 15, and 16. The maintenance operation is not accompanied with a troublesome operation to remove the DC power source unit 1 from the image forming apparatus 101. With this configuration, the image forming apparatus 101 excellent in service workability can be provided.

As illustrated in FIG. 9, four parts (the power source box 19, the first power source substrate support plate 14, the relay substrate support plate 13, and the third power source substrate support plate 16) are combined with the fastening screws 20 in an overlapped way. Thus, the DC power source unit 1 forms a housing surface that defines the inside of the DC power source unit 1 and the inside of the image forming apparatus 101.

According to the present exemplary embodiment, since each of the power source substrate support plates 14, 15, and 16 is securely brought into close contact with the power source box 19 on a fixing surface by the fastening screws 20 (described above), a small gap is formed between the power source box 19 and each of the plates on a plate insertion direction leading edge side opposite to a fixing surface side. More specifically, each of the power source substrate support plates 14, 15, and 16 is supported in a form of a cantilever at the fixing surface by the fastening screws 20 as a base point. Consequently, noise vibration of the plates is likely to be amplified on the plate insertion direction leading edge side which is the cantilever free end.

In the present exemplary embodiment, the power source substrate support plates 14, 15, and 16 are provided with three contacts 14*a*, 15*a*, and 16*a* having elastic deformability, respectively, on the plate insertion direction leading edge side. When the contacts 14*a*, 15*a*, and 16*a* come into contact with dimple shapes 19*a* protruding toward the inner surface side of the power source box 19 and elastically deform, a ground connection with the power source box 19 is made with predetermined contact pressure. In this configuration, since the cantilever free end of each of the plates becomes a fixed end, the cantilever configuration is improved into a double-sided beam configuration, which can reduce an amplitude of noise vibration.

The configuration of the contacts 14*a*, 15*a*, and 16*a* eliminates the need of adding a fastening screws 20 for a ground connection on the plate insertion direction leading edge side of each of the power source substrate support plates 14, 15, and 16, whereby an amplitude of radiation noise can be reduced without degrading service workability. With this configuration, a ground connection can also be made without forming an opening on the housing surface of the DC power source unit 1, and thus a housing having enclosed side surfaces can be ensured, whereby radiation noise can be reliably shielded. In addition, with this configuration, an independent air path not communicating with the inside of the image forming apparatus 101 can be formed, whereby a configuration not affecting other airflows can be realized.

Figure 10B:
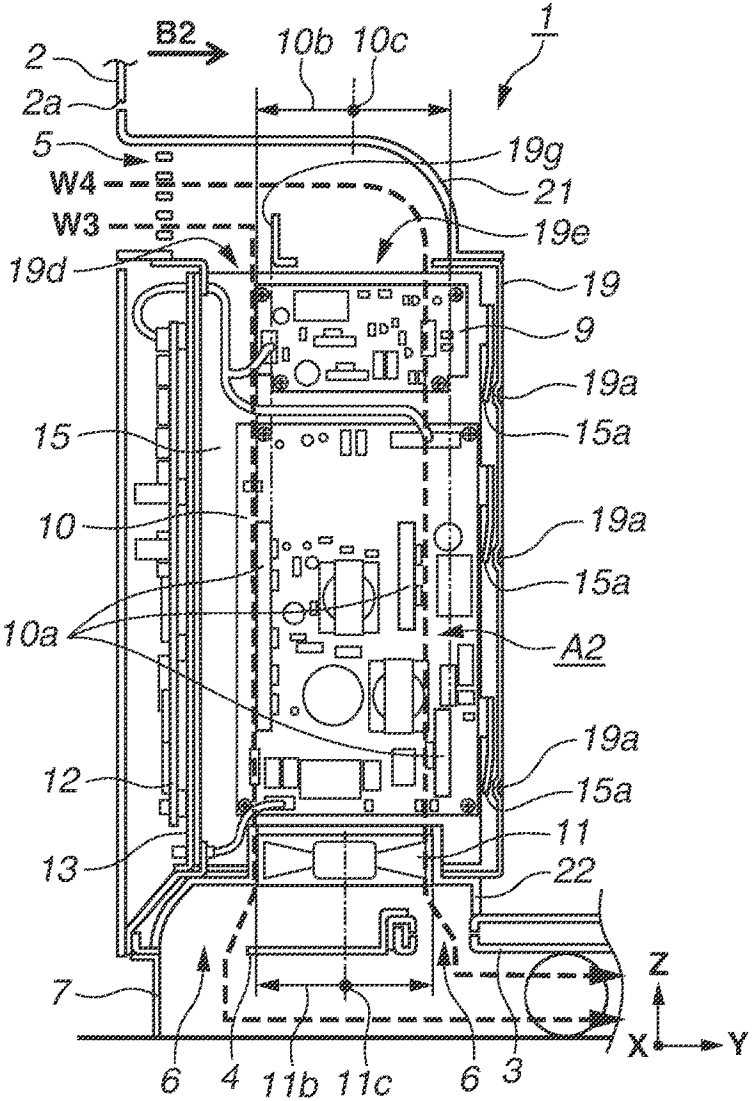
FIGS. 10A and 10B are schematic cross-sectional views illustrating airflow configurations of the DC power source unit of the image forming apparatus.
Figure 10A:
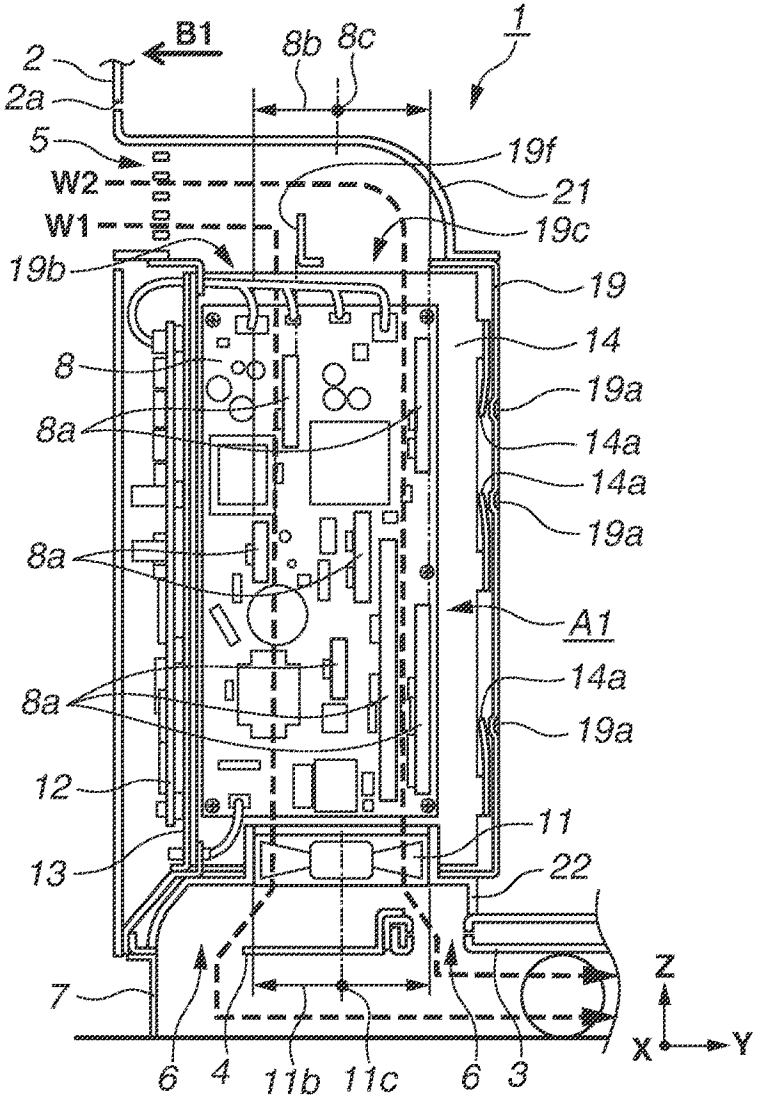

FIG. 10A is a cross-sectional view illustrating an airflow configuration for the first DC power source substrate 8 in the first area A1 in the DC power source unit 1 when viewed from the left face side. FIG. 10B is a cross-sectional view illustrating an airflow configuration for the second DC power source substrate 10 in the second area A2 in the DC power source unit 1 when viewed from the left face side.

As illustrated in FIGS. 10A and 10B, a power source air intake duct 21 is disposed at the top of the DC power source unit 1 and tightly bonded with an upper surface of the power source box 19. The power source air intake duct 21 has the power source intake opening 5 exposed from the opening 2*a* on the rear cover 2 to the rear surface of the image forming apparatus 101. In this configuration, ambient air for cooling taken from the power source intake opening 5 is horizontally supplied, downwardly bent, and then supplied into the power source box 19 at the lower portion, without communicating with the inside of the image forming apparatus 101.

A power source exhaust duct 22 is disposed at the lower portion of the DC power source unit 1 and tightly bonded with a bottom surface of the power source box 19. The power source exhaust duct 22 has a shape for holding the power source exhaust fan 11 and forms a closed duct shape in a state of being attached to the bottom plates 3 and 4. In this configuration, heat emitted from the DC power source substrates 8 and 10 in the power source box 19 is discharged through the exhaust openings 6*a* and 6*b* formed on the bottom plates 3 and 4 from the image forming apparatus 101, without communicating with the inside of the image forming apparatus 101.

The heat discharged from the exhaust openings 6*a* and 6*b* flows through a space between the bottom plates 3 and 4 and the floor surface and then discharged to a direction opposite to the power source intake opening 5 in the anteroposterior direction of the image forming apparatus 101 by the shielding sheet 7 disposed across the bottom plate 4 and the floor surface. Accordingly, the heat discharged from the exhaust openings 6*a* and 6*b* is blocked from flowing into the power source intake opening 5.

For each electronic element which reaches high temperature, heat sinks 8*a* and 10*a* made of a highly heat conductive material, such as aluminum, are mounted on the first DC power source substrate 8 and the second DC power source substrate 10 in the vertically extending direction illustrated in FIGS. 10A and 10B. The heat sinks 8*a* and 10*a* radiate heat absorbed from electronic elements to the ambient air.

According to the present exemplary embodiment, air can be applied to wider surface ranges of the heat sinks 8*a* and 10*a* by approximately matching the extending direction of the heat sinks 8*a* and 10*a* with an airflow direction of the power source exhaust fan 11, whereby efficiency of heat radiation from the DC power source unit 1 can be improved.

A widthwise center 11*c* of the power source exhaust fan 11 is set at a position that approximately coincides with a widthwise center 8*c* of a mounting region for all of heat sinks mounted on the first DC power source substrate 8, and a widthwise center 10*c* of a mounting region for all of heat sinks mounted on the second DC power source substrate 10. According to the present exemplary embodiment, the first DC power source substrate 8 and the second DC power source substrate 10 have differences from each other in the widths, mounting widths 8*b* and 10*b* for all of the heat sinks, and mounting width centers 8*c* and 10*c* for all of the heat sinks.

Thus, according to the present exemplary embodiment, the first DC power source substrate 8 is supported by the first power source substrate support plate 14 at a position deviated in a direction of an arrow B1 illustrated in FIG. 10A with respect to the power source exhaust fan 11 in common, in the power source box 19. The second DC power source substrate 10 is supported by the second power source substrate support plate 15 at a position deviated in a direction of an arrow B2 illustrated in FIG. 10B, in the power source box 19. In this configuration, the widthwise center 8*c*, 10*c*, and 11*c* approximately coincide with each other. Further, a width 11*b* of the power source exhaust fan 11 is configured to be approximately equal to the mounting width 8*b* of all of the heat sinks on the first DC power source substrate 8, and the mounting width 10*b* of all of the heat sinks on the second DC power source substrate 10. With these configurations, air can be uniformly applied between the DC power source substrates 8 and 10 by the power source exhaust fan 11 with respect to all of the heat sinks 8*a* and 10*a*, whereby efficiency of heat radiation from the DC power source unit 1 can be improved.

On the upper surface of the power source box 19, two openings 19*b* and 19*c* are formed for the first DC power source substrate 8, and two openings 19*d* and 19*e* are formed for the second DC power source substrate 10. Rectifying plates 19*f* and 19*g* having a bent shape are formed at the openings 19*b* and 19*d*, respectively, on an upstream side close to the power source intake opening 5.

Broken-line arrows W1, W2, W3, and W4 in FIGS. 10A and 10B indicate airflows in the DC power source unit 1. As drawn with the arrows W1 and W3 in FIGS. 10A and 10B, respectively, in a range below the power source intake opening 5 where the rectifying plates 19*f* and 19*g* are disposed, the horizontal airflow supplied from the power source intake opening 5 abuts against the rectifying plates 19*f* and 19*g* to be perpendicularly downwardly bent and then supplied into the power source box 19 via the openings 19*b* and 19*d*, respectively, on the upstream side. The positions where the rectifying plates 19*f* and 19*g* are disposed are also positions where the downward air volume further increases. Thus, as indicated by the chain double-dashed lines in FIGS. 10A and 10B, it is desirable to dispose the rectifying plates 19*f* and 19*g* at the positions directly above lines approximately matching with the surfaces of the heat sinks 8*a* and 10*a* disposed closest to the power source intake opening 5 where air flow is not smooth since a large air bending resistance occurs, and the plane of the heat sinks 8*a* and 10*a* where a larger air volume is required since a large amount of heat is radiated.

On the other hand, as indicated by the broken-line arrows W2 and W4 in FIGS. 10A and 10B, in a range above the power source intake opening 5 where the rectifying plates 19*f* and 19*g* are not disposed, and the horizontal airflow supplied from the power source intake opening 5 is sent above the rectifying plates 19*f* and 19*g*, downwardly bent while being curved along a curve of the power source air intake duct 21, and then supplied into the power source box 19 via the openings 19*c* and 19*e* on the downstream side. The positions where the openings 19*c* and 19*e* on the downstream side are disposed are also positions where a range on the downstream side producing a downward airflow is restricted. Thus, as indicated by the chain double-dashed lines in FIGS. 10A and 10B, it is desirable to dispose the openings 19*c* and 19*e* directly above the positions on lines approximately matching with the surfaces of the heat sinks 8*a* and 10*a* disposed on the most downstream side. This arrangement can prevent air diffusion on the further downstream side where the heat sinks 8*a* and 10*a* are not provided.

The openings 19*b*, 19*c*, 19*d*, and 19*e* and rectifying plates 19*f* and 19*g* can be disposed at mutually different positions between the first area A1 and the second area A2. More specifically, the openings 19*b*, 19*c*, 19*d*, and 19*e* and the rectifying plates 19*f* and 19*g* can be disposed at positions optimized according to different arrangements of the heat sinks 8*a* and 10*a* between the first DC power source substrate 8 and the second DC power source substrate 10.

The rectifying plates 19*f* and 19*g* can be disposed at different height levels between the first area A1 and the second area A2. More specifically, according to different arrangements and different amounts of heat radiation of the heat sinks 8*a* and 10*a* between the first DC power source substrate 8 and the second DC power source substrate 10, the rectifying plates 19*f* and 19*g* can be disposed at optimized height levels by which required volumes of air supplied in the directions indicated by the broken-line arrows W1 and W3 below the power source intake opening 5 and required volumes of air supplied in the directions indicated by the broken-line arrows W2 and W4 above the power source intake opening 5 are proportioned.

In the above-described configurations of the openings 19*b*, 19*c*, 19*d*, and 19*e* and the rectifying plates 19*f* and 19*g*, required suitable air volumes are applied to the heat sinks 8*a* and 10*a* mounted on the DC power source substrates 8 and 10, respectively, whereby efficiency of heat radiation from the DC power source unit 1 can be improved.

As described above, with the configuration of the DC power source unit 1 according to the present exemplary embodiment, ambient air as cooling air can be taken in from power source intake opening 5, and heat emitted from the heat sinks 8*a* and 10*a* can be uniformly and effectively exhausted through the exhaust openings 6*a* and 6*b* from the image forming apparatus 101. Thus, temperatures of electronic elements mounted on the DC power source substrates 8 and 10 can be maintained to suitable temperatures. Accordingly, the image forming apparatus 101 having high productivity, high stability, and a long life expectancy without productivity degradation, operation failures, and troubles due to insufficient output power of the DC power source substrates 8 and 10 can be provided. As described above, the DC power source unit 1 according to the present exemplary embodiment is an example of a first duct unit, the power source air intake duct 21 is an example of a first intake portion, the power source exhaust duct 22 is an example of a first exhaust portion, and the power source exhaust fan 11 is an example of a first air blowing fan.

The airflows in the DC power source unit 1 according to the present exemplary embodiment can be configured by the enclosed housing not communicating with the image forming stations 200 and the fixing unit 301 in the image forming apparatus 101, and configured by independent air paths that directly take in and exhaust air from and to the outside of the image forming apparatus 101.

Therefore, the present exemplary embodiment enables providing the image forming apparatus 101 excellent in environment-friendliness that does not emit ozone, dust particles, VOCs, or UFPs through the exhaust openings 6*a* and 6*b* of the DC power source unit 1 from the image forming apparatus 101, even in a case where the image forming apparatus 101 is an image forming apparatus for commercial printing having a large air volume of the power source exhaust fan 11.

<Other Exemplary Embodiments>

In the above-described exemplary embodiment, the image forming apparatus 101 includes the housing of the image forming unit 102 and the housing of the fixing conveyance unit 103. The above-described exemplary embodiment is also applicable to an image forming apparatus having only one housing or three or more housings. Even in this case, an airflow configuration similar to that according to the above-described exemplary embodiment can prevent emission of ozone, dust particles, VOCs, and UFPs from exhaust openings of the DC power source unit 1 even in a case where volumes of the air blowing fans that form the airflows in the DC power source unit 1 are set to be large. Accordingly, this configuration can further reduce amounts of emission of ozone, dust particles, VOCs, and UFPs from the image forming apparatus 101, whereby the image forming apparatus 101 excellent in environment-friendliness can be provided.

According to the present exemplary embodiments, an image forming apparatus that can further reduces emission amounts of ozone, dust particles, VOCs, and UFPs can be provided.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-207099, filed Dec. 14, 2020, which is hereby incorporated by reference herein in its entirety.

What is claimed is:

1. An image forming apparatus including an image forming unit to form a toner image on a sheet, the image forming apparatus comprising:

a fixing unit configured to heat the sheet to fix the toner image formed by the image forming unit onto the sheet;

a power source substrate configured to supply power to the image forming apparatus;

a cover provided with an intake opening and configuring at least a part of an exterior of the image forming apparatus;

a first duct unit which is provided with the power source substrate inside the first duct unit, wherein the first duct unit includes a first intake portion configured to take air in from an outside of the image forming apparatus in the first duct unit via the intake opening of the cover, and includes a first exhaust portion configured to exhaust the air taken in from the first intake portion to an outside of the image forming unit;

a first air blowing fan configured to form an airflow from the first intake portion to the first exhaust portion;

a second duct unit including a second intake portion configured to take air in from a neighborhood of the fixing unit inside the image forming apparatus, and a second exhaust portion configured to exhaust the air taken in from the second intake portion to the outside of the image forming apparatus;

a filter disposed between the second intake portion and the second exhaust portion in an airflow from the second intake portion to the second exhaust portion; and a second air blowing fan configured to form the airflow from the second intake portion to the second exhaust portion, wherein the first exhaust portion is disposed at a vertically lower portion than the first intake portion.

2. The image forming apparatus according to claim 1, further comprising:

a third duct unit including a third intake portion configured to take air in from a neighborhood of the image forming unit inside the image forming apparatus, including a third exhaust portion configured to exhaust the air taken in from the third intake portion to the outside of the image forming apparatus, and including a filter disposed between the third intake portion and the third exhaust portion in an airflow from the third intake portion to the third exhaust portion; and a third air blowing fan configured to form the airflow from the third intake portion to the third exhaust portion.

3. The image forming apparatus according to claim 1, wherein the first exhaust portion faces an installation surface where the image forming apparatus is installed.

4. The image forming apparatus according to claim 1, further comprising:

a support frame member including a bottom plate, a plurality of brace members, a first side plate, and a second side plate, wherein the bottom plate is provided with a plurality of casters configured to rotate to make the image forming apparatus movable, and the plurality of brace members vertically upwardly extends with respect to the bottom plate, wherein the first side plate is configured to connect the plurality of brace members, and the second side plate is configured to support the image forming unit together with the first side plate and is disposed at a second side plate position that is closer to a rear face side than the first side plate in an anteroposterior direction of the image forming apparatus, and wherein the cover is disposed at a cover position that is closer to the rear face side than the second side plate in the anteroposterior direction, and the first duct unit is disposed between the second side plate and the cover.

5. The image forming apparatus according to claim 4, wherein the bottom plate is provided with an exhaust opening, and wherein the first exhaust portion exhausts air to the outside of the image forming apparatus via the exhaust opening.

6. The image forming apparatus according to claim 5, wherein the bottom plate includes a first bottom plate provided with the plurality of casters and a second bottom plate disposed at a second bottom plate position that is closer to the rear face side than the first bottom plate in the anteroposterior direction and fixed to the first bottom plate, and wherein the exhaust opening is disposed on the second bottom plate.

7. The image forming apparatus according to claim 1, wherein the first duct unit includes a rectifying plate configured to guide the air taken in from the first intake portion in a vertical direction.

8. The image forming apparatus according to claim 1, wherein the power source substrate includes a substrate on which electrical components are mounted, and wherein the first air blowing fan is disposed on a vertically lower side than the electrical component mounted substrate.

9. The image forming apparatus according to claim 1, wherein the image forming apparatus includes a first housing including the image forming unit, and a second housing including the fixing unit and disposed adjacent to the first housing, and wherein the first duct unit is disposed in the first housing.

10. An image forming apparatus comprising:

a power source substrate configured to supply power to the image forming apparatus;

a cover configuring at least a part of an exterior of the image forming apparatus, wherein the cover is provided with an intake opening on a rear face side in an anteroposterior direction of the image forming apparatus;

a first duct unit which is provided with the power source substrate inside the first duct unit, wherein the first duct unit includes a first intake portion configured to take air in from an outside of the image forming apparatus in the first duct unit via the intake opening of the cover, and includes a first exhaust portion configured to exhaust the air taken in from the first intake portion to an outside of an image forming unit;

a first air blowing fan configured to form an airflow from the first intake portion to the first exhaust portion; and a support frame member including a bottom plate, a plurality of brace members, a first side plate, and a second side plate, wherein the bottom plate faces an installation surface where the image forming apparatus is installed, and the plurality of brace members vertically upwardly extends with respect to the bottom plate, wherein the first side plate is configured to connect the plurality of brace members, and the second side plate is configured to support the image forming unit together with the first side plate and is disposed at a second side plate position that is closer to a rear face side than the first side plate in the anteroposterior direction of the image forming apparatus, and wherein the cover is disposed at a cover position that is closer to the rear face side than the second side plate in the anteroposterior direction, and the first duct unit is disposed between the second side plate and the cover, wherein the bottom plate is provided with an exhaust opening, and wherein the first exhaust portion exhausts air to the outside of the image forming apparatus via the exhaust opening.

11. The image forming apparatus according to claim 10, wherein the first exhaust portion is disposed at a vertically lower portion than the first intake portion.

12. The image forming apparatus according to claim 10, wherein the first duct unit further includes other substrates, and wherein the other substrates are stacked with respect to the power source substrate in a lateral direction of the image forming apparatus.

13. The image forming apparatus according to claim 10, wherein the first duct unit further includes a storage space configured to store the power source substrate, wherein the power source substrate is provided with a first heat sink, and a second heat sink is disposed at a second heat sink position that is closer to a front side than the first heat sink in the anteroposterior direction of the image forming apparatus, and wherein the first intake portion includes a first intake opening, a second intake opening disposed at a second intake position that is closer to a front side than the first intake opening in the anteroposterior direction of the image forming apparatus, and a rectifying plate disposed between the first intake opening and the second intake opening.

14. The image forming apparatus according to claim 10, wherein the first duct unit includes a first sheet metal configured to form a storage space for storing the power source substrate, and a second sheet metal configured to support the power source substrate, and wherein the second sheet metal includes a contact portion disposed on a front side in the anteroposterior direction of the image forming apparatus and configured to come into contact with the first sheet metal, and a fixed portion disposed on a rear side in the anteroposterior direction and configured to be fixed to the first sheet metal.

15. The image forming apparatus according to claim 14, wherein the first sheet metal includes a protruding portion configured to come into contact with the contact portion of the second sheet metal, and wherein the contact portion of the second sheet metal is elastically deformable.

* * * * *